US009174221B2

(12) United States Patent
Nishijima et al.

(10) Patent No.: US 9,174,221 B2
(45) Date of Patent: Nov. 3, 2015

(54) METHOD AND APPARATUS FOR SEPARATION OF MIXTURE

(75) Inventors: Shigehiro Nishijima, Osaka (JP); Fumihito Mishima, Osaka (JP); Koji Kaiso, Yamaguchi (JP); Toshihiro Shimakawa, Yamaguchi (JP)

(73) Assignees: OSAKA UNIVERSITY, Osaka (JP); UBE INDUSTRIES, LTD., Yamaguchi (JP)

( * ) Notice: Subject to any disclaimer, the term of this patent is extended or adjusted under 35 U.S.C. 154(b) by 0 days.

(21) Appl. No.: 14/008,049

(22) PCT Filed: Mar. 28, 2012

(86) PCT No.: PCT/JP2012/058154
§ 371 (c)(1),
(2), (4) Date: Sep. 27, 2013

(87) PCT Pub. No.: WO2012/133537
PCT Pub. Date: Apr. 10, 2012

(65) Prior Publication Data

US 2014/0014559 A1 Jan. 16, 2014

(30) Foreign Application Priority Data

Mar. 31, 2011 (JP) ..... 2011-079551

(51) Int. Cl.
*B03C 1/30* (2006.01)
*B03C 1/00* (2006.01)
(Continued)

(52) U.S. Cl.
CPC ... *B03C 1/30* (2013.01); *B03B 5/44* (2013.01); *B03C 1/002* (2013.01); *B03C 1/015* (2013.01); *B03C 1/288* (2013.01); *B03C 1/32* (2013.01); *B03C 2201/18* (2013.01)

(58) Field of Classification Search
CPC ..... B03C 1/00; B03C 1/02; B03C 1/002; B03C 1/30; B03C 1/32; B03C 1/035; B03C 1/26; B03C 2201/18; B03B 5/44
USPC ..... 209/213, 214, 226, 227, 231, 232, 636, 209/172, 172.5, 39, 40
See application file for complete search history.

(56) References Cited

U.S. PATENT DOCUMENTS 4,025,448 A 5/1977 Sudol
2002/0153295 A1* 10/2002 Kimura et al. ..... 210/222
(Continued)

FOREIGN PATENT DOCUMENTS

EP 1 181 982 A1 2/2002
EP 2 679 310 A1 1/2014
(Continued)

OTHER PUBLICATIONS

Kimura, T., et al., "Chemistry and Education", 50 (4), The Chemical Society of Japan, 2002, pp. 264-265.
(Continued)

*Primary Examiner* — Prasad Gokhale
(74) *Attorney, Agent, or Firm* — Eckert Seamans Cherin & Mellott, LLC; Grant E. Coffield; John P. Powers

(57) ABSTRACT

Provided are a mixture separation method and a separation apparatus in which agglomeration of particles contained in the mixture is suppressed, energy required in distillation treatment of a supporting liquid is small in comparison with conventional methods, and particles that cannot be separated by conventional methods can be separated from a mixture containing the particles. The separation method and separation apparatus of the present invention separate, by type, a plurality of types of particles formed of mutually different materials by applying a magnetic field having a magnetic field gradient to the mixture containing the plurality of types of particles in the supporting liquid. Alternatively, the separation method and separation apparatus of the present invention separate a specific type of particle from such mixture. The supporting liquid is an organic solvent solution obtained by dissolving one or more types of paramagnetic compounds in an organic solvent. The plurality of types of particles includes particles of an inorganic salt, an organic acid salt, an inorganic oxide or a macromolecular compound. The organic solvent may be selected from the group consisting of alcohols, ethers, nitriles, ketones, esters, amides, sulfoxides, halomethanes and hydrocarbon solvents.

10 Claims, 11 Drawing Sheets

(51) Int. Cl.

| | |
|---|---|
| ***B03C 1/015*** | (2006.01) |
| ***B03C 1/28*** | (2006.01) |
| ***B03B 5/44*** | (2006.01) |
| ***B03C 1/32*** | (2006.01) |

(56) References Cited

U.S. PATENT DOCUMENTS

| | | | | |
|---|---|---|---|---|
| 2008/0164183 | A1* | 7/2008 | Marston et al. | 209/214 |
| 2010/0108578 | A1* | 5/2010 | Dittmer et al. | 209/636 |
| 2011/0049017 | A1* | 3/2011 | Rem et al. | 209/3 |
| 2012/0080360 | A1* | 4/2012 | Stone et al. | 209/214 |
| 2013/0327684 | A1* | 12/2013 | Nishijima et al. | 209/212 |

FOREIGN PATENT DOCUMENTS

| | | | |
|---|---|---|---|
| JP | 61-078375 | A | 4/1986 |
| JP | 63-315159 | A | 12/1988 |
| JP | 64-34454 | A | 2/1989 |
| JP | 2000-271507 | A | 10/2000 |
| JP | 2002-59026 | A | 2/2002 |
| JP | 2002-153738 | A | 5/2002 |
| JP | 2002-153770 | A | 5/2002 |
| JP | 2003-320271 | A | 11/2003 |
| JP | 2004-337748 | A | 12/2004 |
| JP | 2007-203205 | A | 8/2007 |
| WO | 2009/108047 | A1 | 9/2009 |

OTHER PUBLICATIONS

Mishima, F., et al., "High Gradient Superconducting Magnetic Separation for Iron Removal From the Glass Polishing Waste", IEEE Transactions on Applied Superconductivity, vol. 21, No. 3, Jun. 2011, pp. 2059-2062.

Japanese Patent Office, "International Search Report", Jun. 26, 2012, 2 pp.

The International Bureau of WIPO, "English translation of International Preliminary Report on Patentability", Oct. 10, 2013, 6 pp.

European Patent Office, "extended European search report", Nov. 6, 2014, 9 pp.

* cited by examiner 15 wt% Methanol solution of manganese chloride 15 wt% Methanol solution of dysprosium nitrate 15 wt% Methanol solution of terbium nitrate 15 wt% Methanol solution of gadolinium nitrate 15 wt% Methanol solution of holmium nitrate 15 wt% Methanol solution of cobalt nitrate 15 wt% Methanol solution of cobalt chloride 15 wt% Methanol solution of iron chloride 15 wt% Ethanol solution of manganese chloride 15 wt% Ethanol solution of dysprosium nitrate 15 wt% Ethanol solution of gadolinium nitrate 15 wt% Ethanol solution of holmium nitrate 15 wt% Ethanol solution of cobalt nitrate

METHOD AND APPARATUS FOR SEPARATION OF MIXTURE

FIELD OF THE INVENTION

The present invention relates to a mixture separation method and a mixture separation apparatus for separating, by particle type, a mixture containing a plurality of types of particles, or for separating a specific type of particle from the mixture, using a gradient magnetic field.

BACKGROUND OF THE INVENTION

It is known that a magneto-Archimedes effect caused by a magnetic field having a magnetic field gradient (which is referred to as "gradient magnetic field" hereinafter) is used to float or levitate material objects in a supporting liquid. For example, Patent Document 1 and Non-Patent Document 1 described below disclose a method for separating a mixture of a plurality of types of plastic particles by particle type using the magneto-Archimedes effect.

PRIOR ART REFERENCES

Patent Document

[Patent Document 1] JP 2002-59026A

Non-Patent Document

[Non-Patent Document 1] Tsunehisa Kimura and Shogo Mamada, *Chemistry and Education,* 50 (4) pp. 264-265, The Chemical Society of Japan (2002)

DISCLOSURE OF THE INVENTION

Problems to be Solved by the Invention

Patent Document 1 and Non-Patent Document 1 mention that an aqueous solution of a paramagnetic inorganic salt can be used as the supporting liquid, and specifically disclose the results of separating the mixture using an aqueous solution of manganese chloride. However, small particles easily agglomerate in an aqueous solution of a paramagnetic inorganic salt such as an aqueous solution of manganese chloride. It is not preferable that particles thus agglomerate when being separated from a mixture using a gradient magnetic field and a supporting liquid, because the accuracy of separation of the mixture may be deteriorated by agglomerate of different types of particles being produced when the particles of the mixture are small.

The evaporative latent heat and the specific heat capacity (at 20° C.) of water are 539 kcal/g and 0.9986 kcal/g ° C., respectively, and are greater than the evaporative latent heat and the specific heat capacity of an organic solvent. Therefore, if an aqueous solution of a paramagnetic inorganic salt such as an aqueous solution of manganese chloride is used as the supporting liquid for separating the mixture using a gradient magnetic field, a large amount of energy is required when inorganic salts such as manganese chloride and other solutes are collected for recycling or collection by distilling the used supporting liquid.

In Patent Document 1 and Non-Patent Document 1, a mixture of a plurality of types of water-insoluble plastic particles is separated. However, if particles contained in the mixture dissolve in the supporting liquid completely or almost completely, it is difficult to separate and further collect the particles by applying a gradient magnetic field thereto. Particles of inorganic acid salts such as potassium chloride and sodium chloride are contained in industrial waste, especially, in incinerated ash. The particles of inorganic acid salts are soluble in water, and dissolve in an aqueous solution of a paramagnetic inorganic salt completely or almost completely. Therefore, if an aqueous solution of a paramagnetic inorganic salt is used as the supporting liquid as disclosed in Patent Document 1 and Non-Patent Document 1, it is difficult to perform separation and collection on a mixture containing such water-soluble particles using a gradient magnetic field.

The present invention solves the above-described problems, and provides a mixture separation method and a separation apparatus in which agglomeration of particles contained in a mixture is suppressed, energy required in distillation treatment of the supporting liquid is small, and particles that cannot be separated and collected by conventional methods can be separated and collected from a mixture containing said particles.

Means for Solving the Problems

The present invention is directed to a mixture separation method for applying a magnetic field having a magnetic field gradient to a mixture containing a plurality of types of particles formed of mutually different materials in a supporting liquid to separate the plurality of types of particles by type or separate a specific type of particles from the mixture, wherein the supporting liquid is an organic solvent solution obtained by dissolving one or more types of paramagnetic compounds in an organic solvent, and the plurality of types of particles include particles of an inorganic salt, an organic acid salt, an inorganic oxide or a macromolecular compound.

The present invention is directed to a mixture separation apparatus for applying a magnetic field having a magnetic field gradient to a mixture containing a plurality of types of particles formed of mutually different materials in a supporting liquid to separate the plurality of types of particles by particle type or separate a specific type of particles from the mixture, including: a separation tank for storing the supporting liquid; an introducing means for introducing the mixture to the separation tank; and a magnetic field generating means for generating the magnetic field, wherein the supporting liquid is an organic solvent solution obtained by dissolving one or more types of paramagnetic compounds in an organic solvent, the plurality of types of particles include particles of an inorganic salt, an organic acid salt, an inorganic oxide or a macromolecular compound, and a magnetic field gradient of the magnetic field has a vertical component or has a horizontal component in addition to a vertical component.

The present invention may be configured such that the organic solvent is selected from the group consisting of alcohols, ethers, nitriles, ketones, esters, amides, sulfoxides, halomethanes and hydrocarbon solvents.

The present invention may be configured such that the organic solvent is selected from the group consisting of methanol, ethanol, n-propanol, iso-propanol, diethyl ether, tetrahydrofuran, acetonitrile, acetone, ethyl acetate, N-methyl pyrrolidone, N,N-dimethylacetamide, dimethyl sulfoxide, dichloromethane, hexane, and toluene.

The present invention may be configured such that each of the one or more types of paramagnetic compounds is selected from the group consisting of paramagnetic inorganic salts, paramagnetic organic free radicals and paramagnetic organic compound complexes.

The present invention may be configured such that each of the one or more types of paramagnetic compounds is selected from the group consisting of manganese chloride ($MnCl_2$), cobalt chloride ($CoCl_2$), iron chloride ($FeCl_2$), dysprosium nitrate ($DyN_3O_9$), terbium nitrate ($TbN_3O_9$), gadolinium nitrate ($GdN_3O_9$), holmium nitrate ($HoN_3O_9$), cobalt nitrate ($CoN_2O_6$), 2,2,6,6-tetramethylpiperidine-1-oxyl free radical, cobalt octoate, iron (II) phthalocyanine, iron (III) acetylacetone, tris(dibenzoylmethanato) iron, and N,N'-bis(salicylidene)ethylenediamine iron (II).

The present invention may be configured such that the inorganic salt is selected from the group consisting of alkali metal halides, alkali metal phosphates, alkali metal carbonates, alkaline earth metal halides, alkaline earth metal carbonates, alkaline earth metal nitrates, alkaline earth metal sulfates, and ammonium salts of strong acids.

The present invention may be configured such that the organic acid salt is an alkali metal salt of an organic carboxylic acid or an organic sulfonic acid, the inorganic oxide is an oxide of a semimetal element, and the macromolecular compound is a polymer (plastics).

The present invention may be configured such that the magnetic field gradient of the magnetic field has a vertical component, and the plurality of types of particles are arranged, by type, at different heights in the supporting liquid by applying the gradient magnetic field to the mixture in the supporting liquid.

The present invention may be configured such that the specific type of particles are particles of an inorganic salt, an organic acid salt, an inorganic oxide or a macromolecular compound, and float in the supporting liquid by applying the gradient magnetic field to the mixture in the supporting liquid.

The present invention may be configured such that the magnetic field gradient of the magnetic field has a horizontal component, and the plurality of types of particles travel horizontally in the supporting liquid by applying the gradient magnetic field to the mixture in the supporting liquid.

Advantageous Effects of the Invention

In the present invention, since an organic solvent solution obtained by dissolving one or more types of paramagnetic compounds in an organic solvent is used as the supporting liquid, agglomeration of particles in the supporting liquid is suppressed in comparison with the case where an aqueous solution of a paramagnetic inorganic salt such as an aqueous solution of manganese chloride is used as the supporting liquid. In the present invention, since an organic solvent solution obtained by dissolving one or more types of paramagnetic compounds in an organic solvent is used as the supporting liquid, energy required in distillation treatment of a supporting liquid is small in comparison with the case where an aqueous solution of a paramagnetic inorganic salt is used as the supporting liquid. Moreover, in the present invention, since such an organic solvent solution is used as the supporting liquid, particles that are dissolved in the supporting liquid and cannot be separated and collected by conventional methods can be separated and collected from a mixture containing said particles.

DETAILED DESCRIPTION OF THE INVENTION

Figure 1:
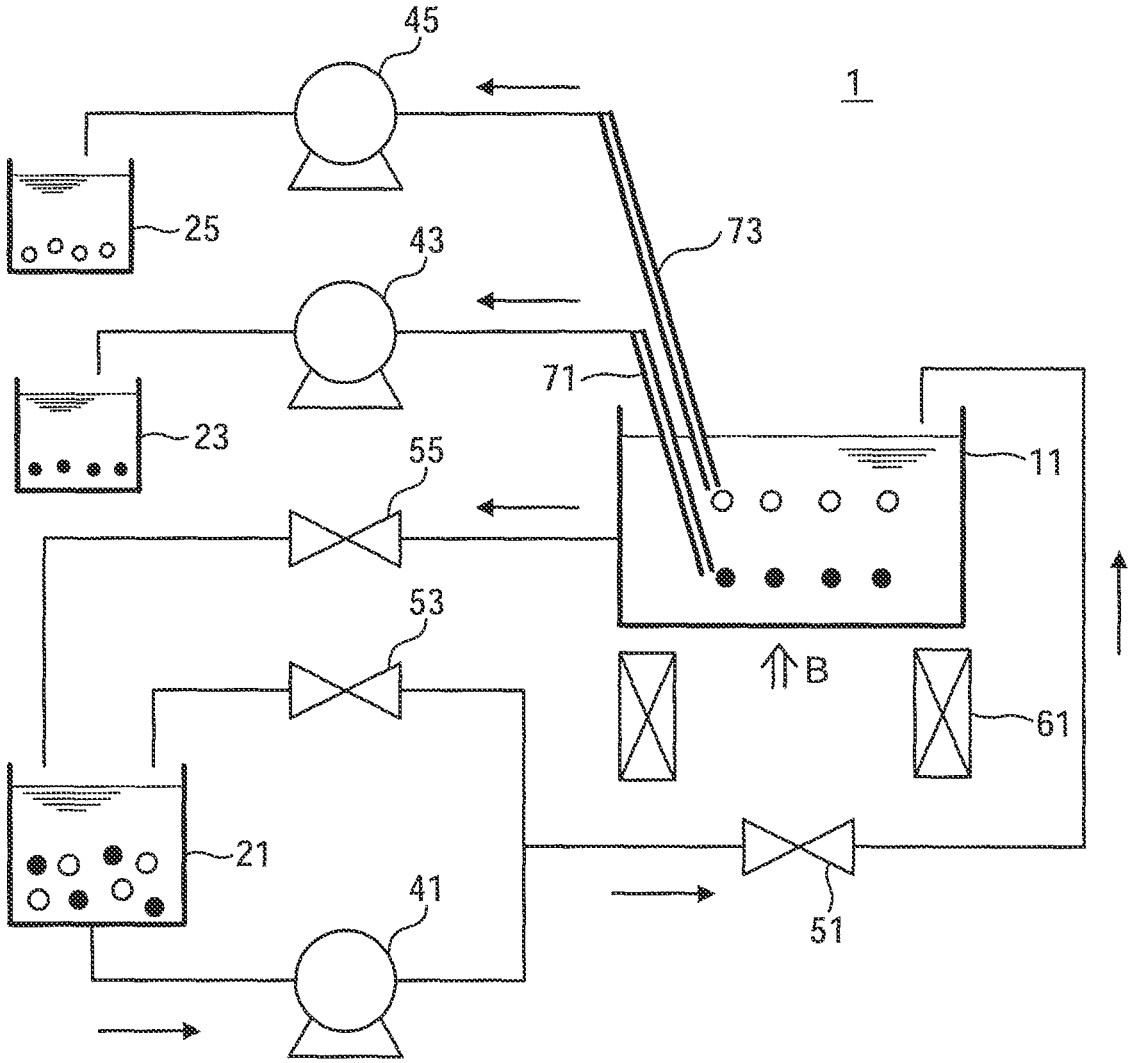
FIG. 1 is an explanatory view showing the outline of a mixture separation apparatus according to a first embodiment of the present invention.

Hereinafter, embodiments of the present invention will be described in detail. The present invention is a mixture separation method using a gradient magnetic field, in which an organic solvent solution obtained by dissolving one or more types of paramagnetic compounds in an organic solvent is used as the supporting liquid into which a mixture is placed, and the mixture to be separated contains particles of an inorganic salt, an organic acid salt, an inorganic oxide or a macromolecular compound.

For example, the particles of an inorganic salt contained in the mixture to be separated by the present invention may be formed of a material selected from the group consisting of alkali metal halides, alkali metal phosphates, alkali metal carbonates, alkaline earth metal halides, alkaline earth metal carbonates, alkaline earth metal nitrates, alkaline earth metal sulfates, and ammonium salts of strong acids. Examples of alkali metal halides include sodium chloride, potassium chloride, cesium chloride and lithium chloride. Examples of alkali metal phosphates include trisodium phosphate, disodium hydrogen phosphate, sodium dihydrogen phosphate and potassium dihydrogen phosphate. Examples of alkali metal carbonates include sodium carbonate. Examples of alkaline earth metal halides include calcium chloride, magnesium chloride, barium chloride and barium bromide. Examples of carbonates, nitrates and sulfates of alkaline earth metal include calcium carbonate, calcium nitrate and magnesium sulfate. Examples of ammonium salts of a strong acid include ammonium sulfate.

For example, the particles of an organic acid salt contained in the mixture to be separated by the present invention may be formed of an alkali metal salt of an organic carboxylic acid or an organic sulfonic acid. Examples of alkali metal salts of organic carboxylic acids or organic sulfonic acids include sodium acetate, sodium octanoate, sodium stearate and sodium 1-heptanesulfonate.

For example, the particles of an inorganic oxide contained in the mixture to be separated by the present invention may be formed of an oxide of a semimetal element. Examples of oxides of semimetal elements include silicon dioxide and aluminum oxide.

For example, the particles of a macromolecular compound contained in the mixture to be separated by the present invention may be formed of a polymer (plastics). Examples of polymers include a polypropylene resin and a nylon 6 resin.

The number of types of particles contained in the mixture to be separated may be two or more, and is not limited in the present invention. The material forming at least one type of particle contained in the mixture may be an inorganic salt, an organic acid salt, an inorganic oxide or a macromolecular compound, and the mixture may be constituted by particles of a plurality of types of an inorganic salt or particles of a plurality of types of an organic acid salt, for example. As long as the effect of the present invention is obtained, the mixture treated by the present invention may contain particles formed of a different type of material in addition to the particles formed of an inorganic salt, an organic acid salt, an inorganic oxide or a macromolecular compound. As far as the particles can be separated by type or a desired type of particle can be separated from the mixture, particles formed of a diamagnetic metal such as copper or a ferromagnetic metal such as iron may be contained in the mixture to be separated by the present invention.

In the present invention, there is no limitation on the size or the particle diameter of the particles contained in the mixture, but it is preferable that the particles have a size or a particle diameter that does not affect the accuracy of separation of the particles. The size or the particle diameter of the particles may be set approximately from several tens microns to several centimeters. In the present invention, there is no limitation on the shape of the particles. The shape or the size of the particles contained in the mixture need not be uniform. For example, the mixture may be formed by crushing a mass of waste.

In the present invention, particles contained in the mixture are separated by type by applying a magnetic field (magnetic flux density) having a magnetic field gradient (magnetic flux density gradient) to the mixture in the supporting liquid. Alternatively, in the present invention, a specific type of particles are separated from the mixture by applying a magnetic field having a magnetic field gradient to the mixture in the supporting liquid.

When a magnetic field having a magnetic field gradient in a vertical direction (z direction) is applied to the particles in the supporting liquid, $F_z$, which is a force per unit volume acting on the particles in the vertical direction, is given by the following equation (where z in the vertically downward orientation is taken as positive).

$$F_z=(\rho_i-\rho_f)g+(\chi_i-\chi_f)B\partial B/\partial z/\mu_0$$

where B is the magnetic field (magnetic flux density), g is the acceleration of gravity, $\rho_i$ is the density of the particles, $\rho_f$ is the density of the supporting liquid, $\chi_i$ is the susceptibility (volume susceptibility) of the particles, $\chi_f$ is the susceptibility (volume susceptibility) of the supporting liquid, $\mu_0$ is the permeability in vacuum, and the subscript i is a positive integer showing the type of particle. The particles rise in the supporting liquid if $F_z$ is negative, and the particles sink in the supporting liquid if $F_z$ is positive. The particles stably float at a certain position or height in the vertical direction due to the magneto-Archimedes effect if $F_z$ is zero.

If $(\rho_i-\rho_f)>0$ (i.e., in the case where the particles sink in the supporting liquid if a gradient magnetic field is not applied), $F_z$ is negative and the particles can rise in the supporting liquid when the supporting liquid is selected or prepared such that $(\chi_i-\chi_f)<0$ and the product of the magnetic field and the magnetic field gradient ($B\partial B/\partial z$) is a large positive value (e.g., when a gradient magnetic field in which the magnetic field increases in the vertically downward orientation is applied to the particles in the supporting liquid). On reaching the height where $F_z$ becomes zero, the particles float stably at that height. Note that the particles float at the liquid surface of the supporting liquid if the height where $F_z$ becomes zero exceeds the height of the liquid surface of the supporting liquid.

If $(\rho_i-\rho_f)<0$ (i.e., in the case where the particles float at the liquid surface of the supporting liquid if a gradient magnetic field is not applied), $F_z$ is positive and the particles can sink in the supporting liquid when the supporting liquid is selected or prepared such that $(\chi_i-\chi_f)<0$ and the product of the magnetic field and the magnetic field gradient is a large negative value (e.g., when a gradient magnetic field in which the magnitude of the magnetic field decreases in the vertically downward orientation is applied to the particles in the supporting liquid). On reaching the height where $F_z$ becomes zero, the particles float stably at that height. Note that the particles precipitate on a bottom face if the height where $F_z$ becomes zero is lower than or equal to that of the bottom face of a tank for storing the supporting liquid.

It is preferable that the volume susceptibility (SI unit system) of the particles of the mixture to be separated by the present invention is in a range of $-9\times10^{-6}$ to $-1\times10^{-3}$, and it is preferable that the density (specific gravity) thereof is in a range of 0.7 g/cm$^3$ to 20 g/cm$^3$.

The height or the position where $F_z$ becomes zero and the particles float stably due to the magneto-Archimedes effect varies depending on the physical properties of the particles, that is, the density $\rho_i$ and the volume susceptibility $\chi_i$ of the particles. Therefore, a plurality of types of particles can be separated by type at different heights (including the liquid surface of the supporting liquid and the bottom face of the tank) using the magneto-Archimedes effect. A specific type of particle that precipitates or sinks in the supporting liquid without the gradient magnetic field can be separated from the mixture (other types of particles) by floating the specific type of particle in the supporting liquid. Furthermore, a specific type of particle that floats at the liquid surface of the supporting liquid without the gradient magnetic field can be separated from the mixture by floating the specific type of particle below the liquid surface, or precipitating the specific type of particle on the bottom face.

The magnetic field gradient of the (gradient) magnetic field used in the present invention may have a component of a horizontal direction (x direction) in addition to a component of a vertical direction (z direction). $F_x$ that is the force per unit volume acting on the particles in the horizontal direction is given by the following equation.

$$F_x=(\chi_i-\chi_f)B\partial B/\partial x/\mu_0$$

The force $F_x$ in the horizontal direction acts on the particles, so that the particles travel in the horizontal direction in the supporting liquid. If the magnetic field gradient has the vertical component and the horizontal component, and a height where $F_z$ becomes zero varies with the horizontal travel of the particles, a height of the particles in the supporting liquid may vary such that the magneto-Archimedes effect is maintained in the vertical direction. For example, when the mixture is placed into the supporting liquid in a separation tank to which the gradient magnetic field is applied, the trajectories of the particles in the supporting liquid may vary depending on the types of particles. It is possible to make the particles travel to a collecting location and to promote the separation of the particles using the force $F_x$ in the horizontal direction. For example, it is possible to guide the particles by type to respective partitioned regions in the separation tank using the force $F_x$ in the horizontal direction.

As long as the effect of the present invention is obtained, there is no limitation on the magnitude or the orientation of the gradient magnetic field that is to be applied to the particles. As long as the effect of the present invention is obtained, there is no limitation on a means for generating the gradient magnetic field, and a permanent magnet, a non-superconducting electromagnet, a superconducting bulk magnet, or a superconducting electromagnet may be used. The gradient magnetic field that is to be applied may be obtained by composition of magnetic fields generated by a plurality of magnets. Furthermore, for example, the gradient magnetic field that is to be applied to the particles may have rotation symmetry around a vertical axis (where it is possible to generate such a gradient magnetic field using, for example, a columnar or disk-shaped bulk magnet, and an electromagnet in which a solenoid coil is used). In this case, the horizontal direction of the magnetic field is a radial direction that is perpendicular to the central axis of the magnetic field or the magnet.

If the mixture treated by the present invention contains particles formed of a ferromagnetic substance such as iron in addition to particles of an inorganic salt, an organic acid salt, an inorganic oxide, or a macromolecular compound, the particles of a ferromagnetic substance may be attracted to a means forming the magnetic field, that is, poles of a magnet. In this case, the particles of an inorganic salt, an organic acid salt, an inorganic oxide, or a macromolecular compound float in the supporting liquid, so that these particles and the particles of a ferromagnetic substance can be separated from each other.

In the present invention, an organic solvent solution obtained by dissolving one or more types of paramagnetic compounds in an organic solvent is used as the supporting liquid. Examples of organic solvents in which the paramagnetic compounds are dissolved include alcohols, ethers, nitriles, ketones, esters, amides, sulfoxides, halomethanes and hydrocarbon solvents.

Examples of alcohols, that is, alcohol-based solvents include methanol, ethanol, n-propanol, iso-propanol and ethylene glycol. Examples of ethers, that is, ether-based solvents include diethyl ether and tetrahydrofuran (THF). Examples of nitriles, that is, nitrile-based solvents include acetonitrile. Examples of ketones, that is, ketone-based solvents include acetone. Examples of esters, that is, ester-based solvents include ethyl acetate. Examples of amides, that is, amide-based solvents include N-methyl pyrrolidone (NMP) and N,N-dimethylacetamide. Examples of sulfoxides, that is, sulfoxide-based solvents include dimethyl sulfoxide (DMSO). Examples of halomethanes, that is, halomethane-based solvents include dichloromethane. Examples of hydrocarbon solvents include hexane and toluene.

A paramagnetic compound is dissolved in an organic solvent to obtain the supporting liquid in which $(\chi_s-\chi_f)<0$. The paramagnetic compound may be selected from paramagnetic inorganic salts, paramagnetic organic free radicals or paramagnetic organic compound complexes. Note that two or more types of paramagnetic compounds may be dissolved in the organic solvent.

Examples of paramagnetic inorganic salts include manganese chloride, cobalt chloride, iron chloride, dysprosium nitrate, terbium nitrate, gadolinium nitrate, holmium nitrate and cobalt nitrate. Examples of paramagnetic organic free radicals include 2,2,6,6-tetramethylpiperidine-1-oxyl free radical (TEMPO). Examples of paramagnetic organic compound complexes include cobalt octoate, iron (II) phthalocyanine, iron (III) acetylacetone, tris(dibenzoylmethanato) iron and N,N'-bis(salicylidene)ethylenediamine iron (II).

For example, the evaporative latent heat (evaporative latent heat at room temperature of 20° C.; the same applies hereinafter) of methanol is 264 kcal/g and the specific heat capacity (specific heat capacity at room temperature of 20° C.; the same applies hereinafter) thereof is 0.599 kcal/g ° C. The evaporative latent heat of ethanol is 201 kcal/g and the specific heat capacity thereof is 0.569 kcal/g ° C. The evaporative latent heat of iso-propanol is 163 kcal/g and the specific heat capacity thereof is 0.648 kcal/g ° C. The evaporative latent heat of diethylether is 85 kcal/g and the specific heat capacity thereof is 0.556 kcal/g ° C. The evaporative latent heat of tetrahydrofuran is 116 kcal/g and the specific heat capacity thereof is 0.411 kcal/g ° C. The evaporative latent heat of acetonitrile is 191 kcal/g and the specific heat capacity thereof is 0.532 kcal/g ° C. The evaporative latent heat of ethyl acetate is 88 kcal/g and the specific heat capacity thereof is 0.459 kcal/g ° C. The evaporative latent heat of dimethyl sulfoxide is 131 kcal/g and the specific heat capacity thereof is 0.469 kcal/g ° C. The evaporative latent heat of dichloromethane is 79 kcal/g and the specific heat capacity thereof is 0.288 kcal/g ° C. The evaporative latent heat of acetone is 120 kcal/g and the specific heat capacity thereof is 0.487 kcal/g ° C. The evaporative latent heat of hexane is 80 kcal/g and the specific heat capacity thereof is 0.540 kcal/g ° C. The evaporative latent heat of toluene is 87 kcal/g and the specific heat capacity thereof is 0.405 kcal/g ° C. In this manner, since organic solvents have a lower evaporative latent heat and a smaller specific heat capacity than water including strong hydrogen bonds, the organic solvent in which the paramagnetic compound is dissolved can be used as the supporting liquid to reduce energy required in distillation treatment of the supporting liquid in comparison with conventional technology.

Furthermore, the organic solvent in which the paramagnetic compound is dissolved is used as the supporting liquid to suppress agglomeration of the particles in the supporting liquid. By suppressing agglomeration of the particles in the supporting liquid, single types of particle collect and float (or precipitate) at heights depending on the types of particle, without an agglomerate forming a large mass or agglomerates in which a plurality of types of particles are mixed together being produced.

The organic solvent in which the paramagnetic compound is dissolved can be used as the supporting liquid to separate and collect the particles of materials such as an inorganic salt (e.g., potassium chloride and sodium chloride) and an organic acid salt (e.g., sodium acetate) that cannot be separated and collected if an aqueous solution of a paramagnetic inorganic salt such as an aqueous solution of manganese chloride is used as the supporting liquid.

As long as the effect of the present invention is obtained, there is no limitation on a concentration of a paramagnetic compound in the supporting liquid, that is, a concentration of an organic solvent solution of a paramagnetic compound, and the supporting liquid may be prepared as appropriate depending on types of mixture to be treated or particles to be separated, or types of organic solvents to be used. Furthermore, an organic solvent solution of a paramagnetic compound may be prepared as appropriate so as to have a concentration depending on a gradient magnetic field to be applied. Also, a concentration of an organic solvent solution of a paramagnetic compound may be a saturated concentration in order to make the volume susceptibility $\chi_f$ of the supporting liquid larger.

For example, if manganese chloride is used as the paramagnetic compound and methanol is used as the organic solvent, a concentration of manganese chloride in the supporting liquid, that is, a concentration of the methanol solution of manganese chloride may be set from 1 wt % to 40 wt % (saturated concentration). Moreover, it is preferable that the concentration of the methanol solution of manganese chloride is set from 20 wt % to 40 wt %. Note that, in the present invention, a small amount of the mixture may be dissolved in the organic solvent in comparison with the paramagnetic compound that is dissolved in the organic solvent, or a small amount of a certain type of material contained in the mixture may be dissolved in the organic solvent. When a specific type of particles are separated and collected from the mixture, some of the other particles may be dissolved in the organic solvent.

Particles formed of the paramagnetic compound such as manganese chloride may be contained in the mixture to be separated using the present invention, and the particles of the paramagnetic compound and the other type of particles may be separated by type, or the particles of the paramagnetic compound may be separated from the mixture, using the present invention. In this case, it is preferable that the concentration of the organic solvent solution of the paramagnetic compound used as the supporting liquid is constituted as a saturated concentration or almost saturated concentration.

Hereinafter, a mixture separation apparatus according to embodiments of the present invention will be described with reference to the drawings. FIG. 1 is an explanatory view showing the outline of a mixture separation apparatus according to a first embodiment of the present invention. A separation apparatus (1) of the first embodiment separates, by particle type, the mixture of two types of particles that are formed of mutually different materials. In FIG. 1, one type of particle (first particles hereinafter) is indicated by a black circle, and the other type of particle (second particles hereinafter) is indicated by a white circle. At least one of the first particle and the second particle is formed of an inorganic salt, an organic acid salt, an inorganic oxide or a macromolecular compound, and the density and/or the susceptibility of the first particle and the second particle are different from each other.

The separation apparatus (1) includes a storage tank (21) that stores the supporting liquid (organic solvent solution obtained by dissolving one or more types of paramagnetic compounds in an organic solvent) in which the mixture is suspended or dispersed. The supporting liquid stored in the storage tank (21) is carried to a separation tank (11) that stores the supporting liquid via a circulation pump (41). A first valve (51) is provided in a channel from the circulation pump (41) to the separation tank (11). The channel from the circulation pump (41) to the separation tank (11) branches on the upstream side of the first valve (51), and the branching channel is configured to return to the storage tank (21) via a second valve (53). When the separation apparatus (1) is not separating the mixture, the first valve (51) is closed and the second valve (53) is opened, so that the supporting liquid circulates through the storage tank (21), the circulation pump (41) and the second valve (53) without being separated.

When the separation apparatus (1) is separating the mixture, the second valve (53) is closed and the first valve (51) is opened, so that the supporting liquid containing the mixture is introduced from the storage tank (21) to the separation tank (11). An electromagnet (61) serving as a magnetic field generating means that generates a gradient magnetic field to be applied to the particles in the support liquid is provided outside the separation tank (11). In the present embodiment, the electromagnet (61) is a superconducting electromagnet in which a solenoid coil is used and, for example, generates a magnetic field, in which a magnetic field gradient has a vertical component, in the vertical direction (where the magnitude of the magnetic field increases away from the liquid surface of the separation tank (11) in a downward direction). The first particles and the second particles in the support liquid are separated at different heights or positions in the vertical direction in the separation tank (11) by applying the gradient magnetic field. It is preferable that the separation tank (11) is made of a nonmagnetic material such as plastics and nonmagnetic metals (e.g., nonmagnetic stainless steel).

The separation tank (11) is provided with a first suction tube (71) for collecting the first particles and a second suction tube (73) for collecting the second particles. One end of the first suction tube (71) is disposed in correspondence with a floating height of the first particles in the separation tank (11). The other end side of the first suction tube (71) is connected to a first suction pump (43) via the channel, and the separated first particles are carried to a first particle storage tank (23) provided on the downstream side of the first suction pump (43) by being sucked together with the supporting liquid into the first suction tube (71). One end of the second suction tube (73) is disposed in correspondence with a floating height of the second particles in the separation tank (11). The other end side of the second suction tube (73) is connected to a second suction pump (45) via the channel. The separated second particles are carried to a second particle storage tank (25) provided on the downstream side of the second suction pump (45) by being sucked together with the supporting liquid into the second suction tube (73). The first particles in the first particle storage tank (23) and the second particles in the second particle storage tank (25) are removed from the supporting liquid using a collecting means (e.g., a filtering device) (not shown).

A channel from the separation tank (11) to the storage tank (21) is provided via a third valve (55), and the supporting liquid containing no first particles and second particles returns from the separation tank (11) to the storage tank (21). When the separation apparatus (1) is not separating the mixture, the third valve (55) is closed. While the mixture is separated, the flow rate of the supporting liquid entering the separation tank (11) and the flow rate of the supporting liquid flowing out of the separation tank (11) are made to be the same, and the height of the liquid surface of the supporting liquid in the separation tank (11) or the amount of the supporting liquid stored in the separation tank (11) is maintained constant. The mixture to be treated may be placed into the supporting liquid in the storage tank (21) as appropriate, and the supporting liquid may be replenished into the storage tank (21) from a storage tank (not shown) as appropriate.

The case where the mixture contains particles of two types of materials has been described as an example, but one or more types of particles formed of materials that are different from the materials of which the first particles and the second particles are formed may be further contained in the mixture. In this case, the separation apparatus (1) of the first embodiment is provided with a suction tube, a storage tank and the like for each of the one or more types of the particles of the materials. A certain type of particle may float at the liquid surface of the supporting liquid in the separation tank (11), or may precipitate on the bottom face of the separation tank (11).

It is obvious that the separation apparatus (1) of the first embodiment can be used to separate and collect a specific type of particle especially formed of an inorganic salt, an organic acid salt, an inorganic oxide or a macromolecular compound from the mixture. In this case, suction tubes, suction pumps, storage tanks and the like may not need to be provided for the particles that are not separated and collected. If a specific type of particles are collected, all types of particles other than the specific type of particle may precipitate on the bottom face of the separation tank (11), or may float at the liquid surface of the supporting liquid.

Figure 2:
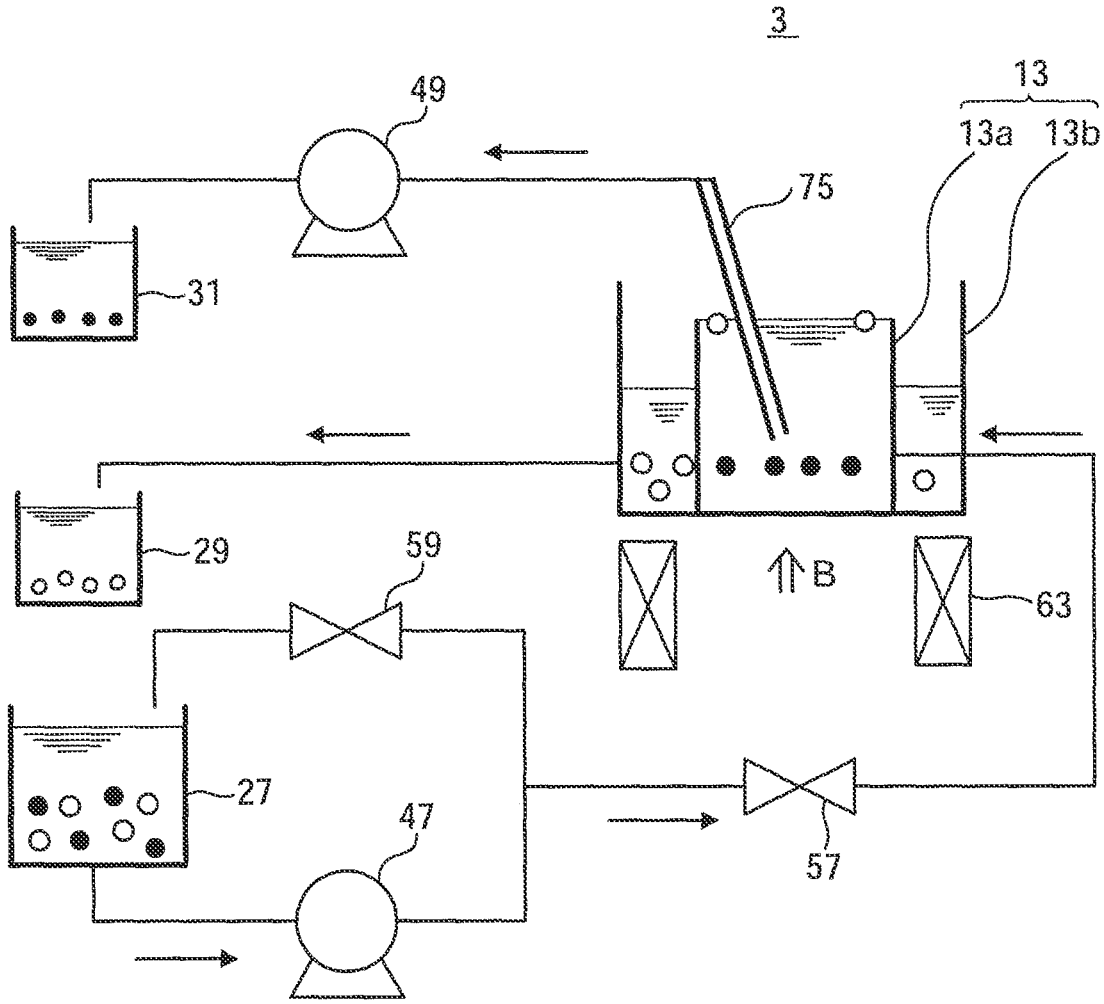
FIG. 2 is an explanatory view showing the outline of a mixture separation apparatus according to a second embodiment of the present invention.

FIG. 2 is an explanatory view showing a second embodiment of a separation apparatus for performing a mixture separation method. A separation apparatus (3) of the second embodiment separates the mixture containing the first particles (indicated by black circles) and the second particles (indicated by white circles) by particle type in the same manner as in the separation apparatus (1) of the first embodiment. At least one of the first particle and the second particles is formed of an inorganic salt, an organic acid salt, an inorganic oxide or a macromolecular compound, and the density and/or the susceptibility of the first particle and the second particle are different from each other.

The separation apparatus (3) includes a storage tank (27) that stores the supporting liquid (organic solvent solution obtained by dissolving one or more types of paramagnetic compounds in an organic solvent) in which the mixture is suspended. The supporting liquid stored in the storage tank (27) is carried to a separation tank (13) that stores the supporting liquid via a circulation pump (47). A channel from the circulation pump (47) to the separation tank (13) branches on the upstream side of a first valve (57) provided in the channel, and the branching channel returns to the storage tank (27) via a second valve (59). When the separation apparatus (3) is not separating the mixture, the first valve (57) is closed and the second valve (59) is opened, so that the supporting liquid circulates through the storage tank (27), the circulation pump (47) and the second valve (59).

When the separation apparatus (3) is separating the mixture, the second valve (59) is closed and the first valve (57) is opened, so that the supporting liquid in which the mixture is suspended is carried from the storage tank (27) to the separation tank (13). The separation tank (13) of the separation apparatus (3) of the second embodiment is an overflow type, and has an inner tank (13*a*) and an outer tank (13*b*). The supporting liquid is carried to the inner tank (13*a*) from the storage tank (27) via the circulation pump (47). It is preferable that the separation tank (13) is made of a nonmagnetic material.

The separation apparatus (3) is provided with an electromagnet (63) serving as a magnetic field generating means that applies a gradient magnetic field to the particles in the support liquid stored in the inner tank (13*a*). In the present embodiment, the electromagnet (63) is a superconducting electromagnet in which a solenoid coil is used, and generates the same gradient magnetic field as the electromagnet (61) of the separation apparatus (1) of the first embodiment. The second particles float at the liquid surface of the supporting liquid and the first particles float at a height below the top of the wall of the inner tank (13*a*) (where the first particles may precipitate on the bottom face of the inner tank (13*a*)) due to the gradient magnetic field generated by the electromagnet (63). Note that the second particles may have a small density and may float at the liquid surface of the supporting liquid even if the gradient magnetic field is not applied thereto.

Since the separation tank (13) is configured such that the supporting liquid introduced to the inner tank (13*a*) overflows into the outer tank (13*b*) over the wall of the inner tank (13*a*), the second particles floating at the liquid surface of the supporting liquid flow into the outer tank (13*b*) with the supporting liquid. Then, the supporting liquid containing the second particles in the outer tank (13*b*) is carried to a second particle storage tank (29). The first particles in the inner tank (13*a*) are carried to a first particle storage tank (31) via a suction tube (75) and a suction pump (49) in the same manner as in the separation apparatus (1) of the first embodiment. The mixture to be treated may be placed into the supporting liquid in the storage tank (27) as appropriate, and the supporting liquid may be replenished into the storage tank (27) from a storage tank (not shown) as appropriate. The first particles in the first particle storage tank (31) and the second particles in the second particle storage tank (29) are removed from the supporting liquid using a collecting means (not shown).

The case where the mixture contains two types of particles has been described as an example, but one or more types of particles formed of materials that are different from the materials of which the first particles and the second particles are formed may be further contained in the mixture. In this case, the one or more types of particles added and the first particles float at different heights in the inner tank (13*a*), and the separation apparatus (3) of the second embodiment is provided with a suction tube, a storage tank and the like for each of the one or more types of the particles of the materials.

It is obvious that the separation apparatus (3) of the second embodiment can be used to separate and collect a specific type of particle especially formed of an inorganic salt, an organic acid salt, an inorganic oxide or a macromolecular compound from the mixture. In this case, particles other than the specific type of particle may float at the liquid surface of the supporting liquid in the inner tank (13*a*), and be carried to the outer tank (13*b*). Furthermore, some types of particles that are not separated and collected may stay in the inner tank (13*a*).

Figure 3:
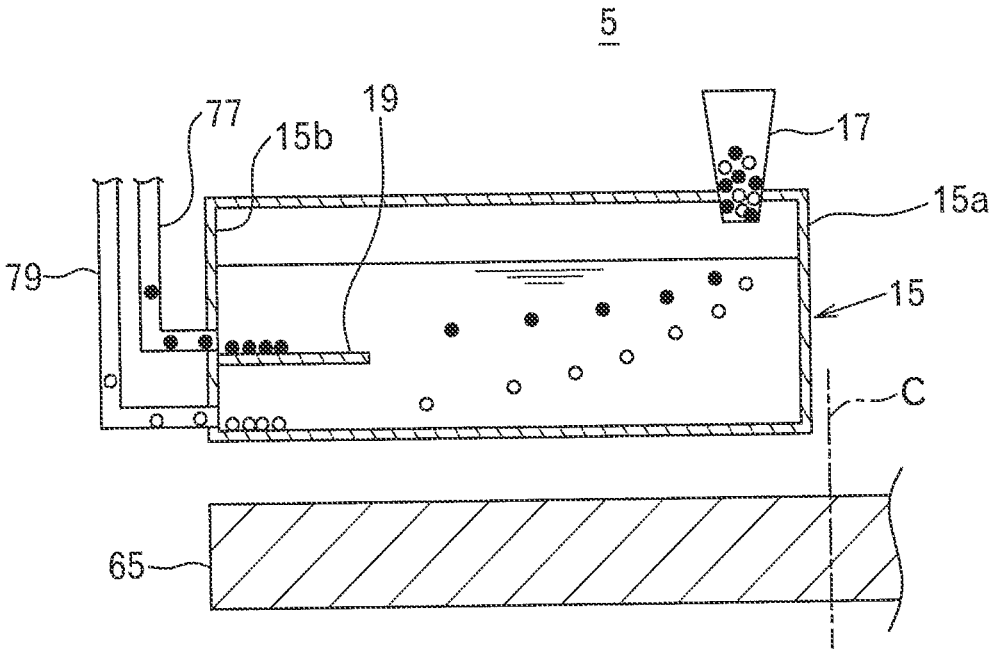
FIG. 3 is an explanatory view showing the outline of a mixture separation apparatus according to a third embodiment of the present invention.

Although a gradient magnetic field that is to be applied to the particles in the supporting liquid is generated using electromagnets in the first embodiment and the second embodiment of the present invention, the present invention may be implemented using bulk magnets or permanent magnets. FIG. 3 is a vertical cross-sectional view showing the outline of a mixture separation apparatus (5) that is a third embodiment of the present invention. In the separation apparatus (5) of the third embodiment, a gradient magnetic field is generated using a superconducting bulk magnet (65).

The superconducting bulk magnet (65) is formed in the shape of a disk or a column, and the separation tank (15), which is approximately cuboid or box-shaped, is disposed over a circular pole face arranged on the upper side. The central axis C of the superconducting bulk magnet (65) is vertically disposed. The supporting liquid (organic solvent solution obtained by dissolving one or more types of paramagnetic compounds in an organic solvent) is stored in the separation tank (15). The separation tank (15) is disposed such that its longitudinal direction is in the radial direction of the pole face of the superconducting bulk magnet (65). A wall portion (15*a*) on the side of one end of the separation tank (15) is disposed in the vicinity of the central axis C of the superconducting bulk magnet (65), and a wall portion (15*b*) on the side of the other end of the separation tank (15) is disposed in the vicinity of the outer edge of the superconducting bulk magnet (65). The width of the separation tank (15) is made to be considerably shorter than the length of the separation tank (15) and the radius of the superconducting bulk magnet (65).

The position of the separation tank (15) with respect to the superconducting bulk magnet (65) may be adjusted as appropriate.

On the wall portion (15*a*) side, that is, the side closer to the central axis C of the superconducting bulk magnet (65), the hopper (17) for placing a mixture is provided in the upper portion of the separation tank (15), and FIG. 3 shows, as an example, a state in which a mixture of the first particles (indicated by black circles) and the second particles (indicated by white circles) is placed into the supporting liquid (where the first particles and the second particles are the same as in the foregoing embodiments). The superconducting bulk magnet (65) generates a magnetic field that is axisymmetric about the central axis C. The magnitude of the magnetic field decreases away from the pole face of the magnet (65) in the vertical direction. Furthermore, the magnitude of the magnetic field decreases away from the central axis C of the magnet (65) in the horizontal direction (in the radial direction). Therefore, the magnetic field gradient of the magnetic field to be applied to the particles in the supporting liquid has a horizontal component in addition to a vertical component, and the first particles and the second particles travel to the wall portion (15*b*) of the separation tank (15) in the radial direction.

Since a balanced position varies due to the magneto-Archimedes effect as the first particles and the second particles travel to the wall portion (15*b*) of the separation tank (15), heights of the first particles and the second particles change (or are lowered). Since the physical properties (susceptibility and/or density) of the first particles and the second particles are different, the first particles and the second particles separate from each other in the vertical direction as they travel to the wall portion (15*b*) of the separation tank (15). A shelf board (19) is provided so as to horizontally project from the wall portion (15*b*) of the separation tank (15). The first particles that have horizontally traveled hit the shelf board (19), are gathered on the shelf board (19), and are collected together with the supporting liquid from the separation tank (15) using a first suction tube (77) that is connected to an outlet disposed on the wall portion (15*b*). Furthermore, the second particles are gathered on the bottom face of the separation tank (15) in the vicinity of the wall portion (15*b*), and are collected together with the supporting liquid from the separation tank (15) using a second suction tube (79) that is connected to an outlet disposed on the wall portion (15*b*). The amount of the supporting liquid stored in the separation tank (15) may be maintained constant by supplying the supporting liquid to the separation tank (15) via a duct (not shown). Furthermore, the first suction tube (77) and the second suction tube (79) may perform suctioning intermittently, and the supporting liquid may be supplied to the separation tank (15) as appropriate in this case.

The first particles travel to the wall portion (15*b*) on the shelf board (19) when they hit the shelf board (19), and the second particles travel to the wall portion (15*b*) on the bottom face of the separation tank (15) when they hit the bottom face. For example, when the first suction tube (77) and the second suction tube (79) is not sucking the particles (and the supporting liquid), these particles stop when they reach the wall portion (15*b*) or cannot travel against the flow resistance of the supporting liquid. The first particles and the second particles separated from each other are divided by the shelf board (19) to improve the accuracy of separation and to easily collect these particles separately. The first particles and the second particles may reach the wall portion (15*b*) and float due to the magneto-Archimedes effect, and the shelf board (19) may not be provided in this case.

The case where the mixture contains two types of particles has been described as an example, but one or more types of particles formed of materials that are different from the materials of which the first particles and the second particles are formed may be further contained in the mixture. In this case, the separation tank (15) is provided with shelf boards and suction tubes for the respective types of added particles.

It is obvious that the separation apparatus (5) of the third embodiment can be used to separate and collect a specific type of particle especially formed of an inorganic salt, an organic acid salt, an inorganic oxide or a macromolecular compound from the mixture. In this case, for example, particles other than the specific type of particle that is separated and collected may be gathered on the bottom face of the separation tank (15).

The separation tank (15) of the mixture separation apparatus (5) of the third embodiment may be cylindrical, the hopper (17) may be disposed at the center of a circular upper face of the separation tank (15), and the separation tank (15) may be further disposed over the superconducting bulk magnet (65) such that the central axis of the separation tank (15) or the hopper (17) is along the central axis C of the superconducting bulk magnet (65). In this case, the shelf board (19), which is ring-shaped, is provided so as to project inward from the wall portion of the separation tank (15). In such a modified mixture separation apparatus (5) of the third embodiment, the first particles and the second particles placed into the supporting liquid via the hopper (17) sink while traveling in the direction perpendicular to the central axis C (i.e., in the radial direction of the pole end face of the magnet (65)) in the supporting liquid. That is to say, the first particles and the second particles in the mixture continuously placed into the supporting liquid are diffused radially from the central axis C of the magnet (65).

It is possible to perform a mixture separation method of the present invention using one of a continuous method and a batch method. Furthermore, in the embodiments described above, the channel connected to the storage tank (21), the hopper (17) or the like is used as an introducing means that introduces the mixture to the separation tank, but there is no limitation on the introducing means that introduces the mixture to the separation tank as long as the effect of the present invention is obtained.

For example, in the separation apparatus (1) of the first embodiment and the separation apparatus (3) of the second embodiment, the first particle of the mixture may be sodium chloride and the second particle may be potassium chloride (see the 1st example etc.). For example, if the first particles of the mixture are sodium stearate and the second particles are sodium octanoate (see Table 1), the electromagnet (61) or (63) may be arranged on the upper side of the separation tank (11), face in the vertical direction, and be configured to generate a gradient magnetic field of which the magnitude decreases in the downward direction. Furthermore, for example, if the first particles of the mixture are sodium 1-heptanesulfonate and the second particles are potassium acetate (see Table 1), magnets shown in FIG. 1 of Patent Document 1 may be used as a magnetic field generating means instead of the electromagnet (61) or (63), and the separation tank (11) or (13) may be arranged between the poles.

EXAMPLES

Hereinafter, examples in which the present invention was actually implemented to separate the mixture will be described in detail.

1st Example

Separation of Potassium Chloride Particles and Sodium Chloride Particles

A methanol solution containing manganese chloride which is a paramagnetic inorganic salt at a concentration of 40 wt % was prepared by dissolving 314.37 g of manganese chloride tetrahydrate in 185.63 g of methanol which is an organic solvent (alcohol-based solvent). Then, 10 ml of the 40 wt % methanol solution of manganese chloride and a mixture of 0.1 g of particles (powder) of potassium chloride which is an inorganic salt and 0.1 g of particles (powder) of sodium chloride which is an inorganic salt were placed into a bottomed cylindrical glass container having an inside diameter of 25 mm, a height of 40 mm and a thickness of 1 mm, and were stirred using a stirring glass rod. The glass container was positioned at the center of the pole face of a columnar neodymium magnet, and a gradient magnetic field having a magnetic field gradient in the vertical direction was applied thereto. The neodymium magnet used had an outside diameter of 30 mm, a height of 15 mm, and a maximum magnitude of the magnetic field (maximum magnetic flux density) of 0.5 T at the center of the pole face. Note that the neodymium magnet was used in combination with a ring-shaped neodymium magnet (maximum magnitude of magnetic field of 0.4 T) having an outside diameter of 70 mm, an inside diameter of 30 mm and a height of 10 mm in order to increase an absolute value of the magnetic field gradient. The columnar neodymium magnet was inserted in a space inside of the ring-shaped neodymium magnet.

As described above, when the glass container containing 10 ml of the 40 wt % methanol solution of manganese chloride including the mixture of 0.1 g of potassium chloride particles and 0.1 g of sodium chloride particles was put over the pole face of the columnar neodymium magnet, the particles were gathered annularly along the inner wall of the glass container at the positions of 4.5 mm and 6 mm from the pole face in the vertical direction (i.e., positions of 3.5 mm and 5 mm from the bottom face of the glass container in the vertical direction). The height of the particles was measured with a ruler.

After being separated and collected with pipettes, and filtered through a membrane filter (made of Teflon (registered trademark), pore diameter of 0.2 μm), the particles gathered on the upper side (5 mm) and the particles gathered on the lower side (3.5 mm) were washed with methanol and dried at 125° C. for 1 hour. As a result of an analysis of the particles on the lower side and the particles on the upper side collected (i.e., after drying) using a fluorescent X ray, it was found that the particles on the lower side were sodium chloride particles and the particles on the upper side were potassium chloride particles.

In this manner, the 40 wt % methanol solution of manganese chloride was used as the supporting liquid and the gradient magnetic field was applied thereto, so that the mixture of potassium chloride particles and sodium chloride particles could be arranged at different heights corresponding to the types of particles and separated by particle type. Note that the total mass of the collected particles (i.e., after drying) was approximately 0.17 g. Approximately 15 wt % of the mixture was not collected due to dissolution in the supporting liquid, attachment to the membrane filter and the like.

2nd Example

Separation of Potassium Chloride Particles and Sodium Chloride Particles

A methanol solution containing manganese chloride at a concentration of 30 wt % was prepared by dissolving 235.78 g of manganese chloride tetrahydrate in 264.22 g of methanol. When the same treatments and measurements as in the 1st example were performed, except that the 30 wt % methanol solution of manganese chloride prepared was used, it was confirmed that sodium chloride particles were gathered annularly along the inner wall of the glass container at a position of 4 mm from the pole face of the neodymium magnet in the vertical direction and potassium chloride particles were gathered annularly along the inner wall of the glass container at a position of 5 mm from the pole face of the neodymium magnet in the vertical direction.

In this manner, even if the 30 wt % methanol solution of manganese chloride was used as the supporting liquid and the gradient magnetic field was applied thereto, the mixture of potassium chloride particles and sodium chloride particles could be arranged at different heights corresponding to the types of particles and separated by particle type. Note that the total mass of the collected particles was approximately 0.14 g. Approximately 30 wt % of the mixture was not collected due to dissolution in the supporting liquid, attachment to the membrane filter and the like.

3rd Example

Separation of Potassium Chloride Particles and Sodium Chloride Particles

A methanol solution containing manganese chloride at a concentration of 20 wt % was prepared by dissolving 157.18 g of manganese chloride tetrahydrate in 342.82 g of methanol. When the same treatments and measurements as in the 1st example were performed, except that the 20 wt % methanol solution of manganese chloride prepared was used, it was confirmed that potassium chloride particles were gathered annularly along the inner wall of the glass container at a position of 2 mm from the pole face in the vertical direction. Sodium chloride particles did not float and precipitated to the bottom portion of the glass container.

In this manner, the 20 wt % methanol solution of manganese chloride was used as the supporting liquid and the gradient magnetic field was applied thereto, so that the mixture of potassium chloride particles and sodium chloride particles could be arranged at different heights corresponding to the types of particles and separated by particle type.

4th Example

Separation of Calcium Carbonate Particles and Sodium Carbonate Particles

When the same treatments and measurements as in the 1st example were performed, except that a mixture of 0.1 g of particles (powder) of calcium carbonate which is an inorganic salt and 0.1 g of particles (powder) of sodium carbonate which is an inorganic salt was used, it was confirmed that calcium carbonate particles were gathered annularly along the inner wall of the glass container at a position of 3 mm from the pole face in the vertical direction and sodium carbonate particles were gathered annularly along the inner wall of the glass container at a position of 5 mm from the pole face in the vertical direction.

In this manner, the 40 wt % methanol solution of manganese chloride was used as the supporting liquid and the gradient magnetic field was applied thereto, so that the mixture of calcium carbonate particles and sodium carbonate particles could be arranged at different heights corresponding to the types of particles and separated by particle type. Note that the total mass of the collected particles was approximately 0.19 g. Approximately 5 wt % of the mixture was not collected due to dissolution in the supporting liquid, attachment to the membrane filter and the like.

5th Example

Separation of Potassium Chloride Particles and Barium Chloride Particles

When the same treatments and measurements as in the 1st example were performed, except that a mixture of 0.1 g of particles (powder) of potassium chloride which is an inorganic salt and 0.1 g of particles (powder) of barium chloride which is an inorganic salt was used, it was confirmed that barium chloride particles were gathered annularly along the inner wall of the glass container at a position of 1.5 mm from the pole face in the vertical direction and potassium chloride particles were gathered annularly along the inner wall of the glass container at a position of 6 mm from the pole face in the vertical direction.

In this manner, the 40 wt % methanol solution of manganese chloride was used as the supporting liquid and the gradient magnetic field was applied thereto, so that the mixture of potassium chloride particles and barium chloride particles could be arranged at different heights corresponding to the types of particles and separated by particle type. Note that the total mass of the collected particles was approximately 0.18 g. Approximately 10 wt % of the mixture was not collected due to dissolution in the supporting liquid, attachment to the membrane filter and the like.

6th Example

Separation of Sodium Chloride Particles and Barium Chloride Particles

When the same treatments and measurements as in the 1st example were performed, except that a mixture of 0.1 g of particles (powder) of sodium chloride which is an inorganic salt and 0.1 g of particles (powder) of barium chloride which is an inorganic salt was used, it was confirmed that barium chloride particles were gathered annularly along the inner wall of the glass container at a position of 1.5 mm from the pole face in the vertical direction and sodium chloride particles were gathered annularly along the inner wall of the glass container at a position of 4.5 mm from the pole face in the vertical direction.

In this manner, the 40 wt % methanol solution of manganese chloride was used as the supporting liquid and the gradient magnetic field was applied thereto, so that the mixture of sodium chloride particles and barium chloride particles could be arranged at different heights corresponding to the types of particles and separated by particle type. Note that the total mass of the collected particles was approximately 0.18 g. Approximately 10 wt % of the mixture was not collected due to dissolution in the supporting liquid, attachment to the membrane filter and the like.

7th Example

Separation of Potassium Bromide Particles and Potassium Chloride Particles

When the same treatments and measurements as in the 1st example were performed, except that a mixture of 0.1 g of particles (powder) of potassium bromide which is an inorganic salt and 0.1 g of particles (powder) of potassium chloride which is an inorganic salt was used, it was confirmed that potassium bromide particles were gathered annularly along the inner wall of the glass container at a position of 4 mm from the pole face in the vertical direction and potassium chloride particles were gathered annularly along the inner wall of the glass container at a position of 6 mm from the pole face in the vertical direction.

In this manner, the 40 wt % methanol solution of manganese chloride was used as the supporting liquid and the gradient magnetic field was applied thereto, so that the mixture of potassium bromide particles and potassium chloride particles could be arranged at different heights corresponding to the types of particles and separated by particle type. Note that the total mass of the collected particles was approximately 0.15 g. Approximately 25 wt % of the mixture was not collected due to dissolution in the supporting liquid, attachment to the membrane filter and the like.

8th Example

Separation of Potassium Chloride Particles and Cesium Chloride Particles

When the same treatments and measurements as in the 1st example were performed, except that a mixture of 0.1 g of particles (powder) of potassium chloride which is an inorganic salt and 0.1 g of particles (powder) of cesium chloride which is an inorganic salt was used, it was confirmed that cesium chloride particles were gathered annularly along the inner wall of the glass container at a position of 2 mm from the pole face in the vertical direction and potassium chloride particles were gathered annularly along the inner wall of the glass container at a position of 6 mm from the pole face in the vertical direction.

In this manner, the 40 wt % methanol solution of manganese chloride was used as the supporting liquid and the gradient magnetic field was applied thereto, so that the mixture of potassium chloride particles and cesium chloride particles could be arranged at different heights corresponding to the types of particles and separated by particle type. Note that the total mass of the collected particles was approximately 0.15 g. Approximately 25 wt % of the mixture was not collected due to dissolution in the supporting liquid, attachment to the membrane filter and the like.

9th Example

Separation of Cerium Dioxide Particles and Silicon Dioxide Particles

When the same treatments and measurements as in the 1st example were performed, except that a mixture of 0.1 g of particles (powder) of cerium dioxide which is an inorganic oxide and 0.1 g of particles (powder) of silicon dioxide (silica) which is an inorganic oxide was used, it was confirmed that cerium dioxide particles were gathered annularly along the inner wall of the glass container on the bottom face of the glass container and silicon dioxide particles were gathered annularly along the inner wall of the glass container at a position of 5 mm from the pole face in the vertical direction.

In this manner, the 40 wt % methanol solution of manganese chloride was used as the supporting liquid and the gradient magnetic field was applied thereto, so that the mixture of cerium dioxide particles and silicon dioxide particles could be arranged at different heights corresponding to the types of particles and separated by particle type. Note that the total mass of the collected particles was approximately 0.15 g. Approximately 25 wt % of the mixture was not collected due to attachment to the membrane filter and the like.

10th Example

Separation of Silica Glass Particles and Alumina Particles

A 20 wt % dimethyl sulfoxide solution of manganese chloride containing manganese chloride which is a paramagnetic inorganic salt at a concentration of 20 wt % was prepared by dissolving manganese chloride tetrahydrate in dimethyl sulfoxide which is an organic solvent (sulfoxide-based solvent). Fifteen milliliters of this 20 wt % dimethyl sulfoxide solution of manganese chloride and a mixture of three transparent beads of silica glass which is an inorganic oxide and three beads of alumina which is an inorganic salt were placed into the same glass container as used in the 1st example and stirred (where a diameter of the silica glass bead and the alumina bead was approximately 1.5 mm). Then, the glass container was disposed at the center of the pole face of a columnar superconducting bulk magnet. The superconducting bulk magnet had a diameter of 60 mm and a height of 20 mm. The superconducting bulk magnet was magnetized using a solenoid superconducting electromagnet, and the magnitude of the magnetic field was 3 T at the center of the pole face.

Figure 4:
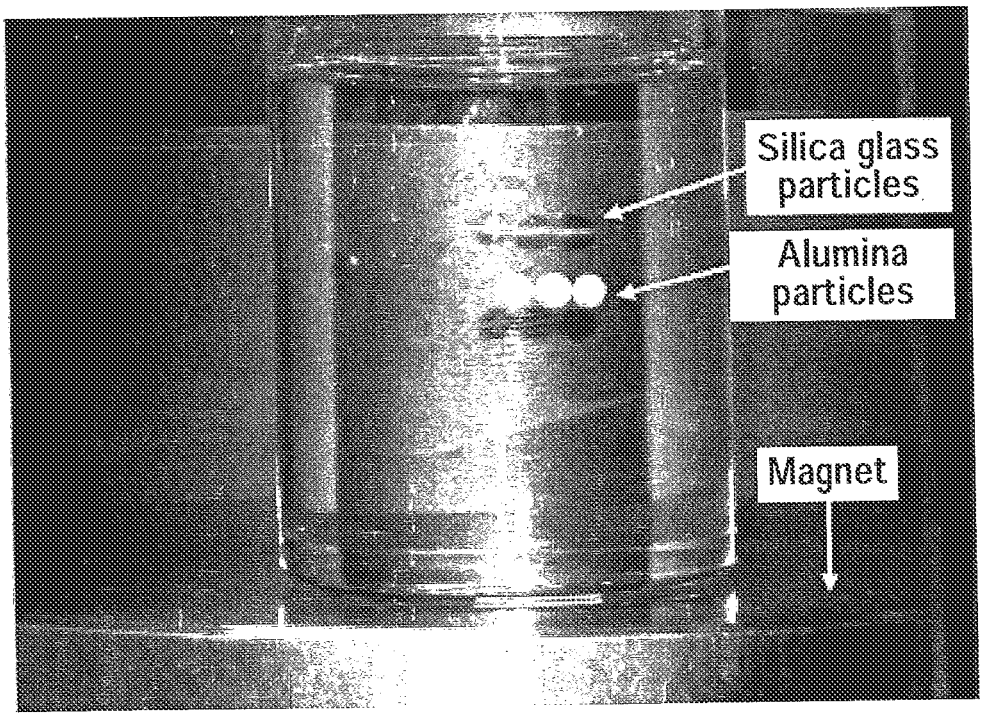
FIG. 4 is a photograph showing a state in which a mixture containing silica glass particles and alumina particles has been separated by type in a 10th example of the present invention.

When the glass container was put over the superconducting bulk magnet, the alumina beads floated at a height of 18 mm from the pole face in the vertical direction and the silica glass beads floated at a height of 25 mm therefrom as shown in FIG. 4. In this manner, the dimethyl sulfoxide solution of manganese chloride was used as the supporting liquid and the gradient magnetic field was applied thereto, so that the mixture of silica glass particles (silica glass beads) and alumina particles (alumina beads) could be arranged at different heights corresponding to the types of particles and separated by particle type.

11th Example

Separation of Silica Glass Particles and Alumina Particles

A 20 wt % N-methyl pyrrolidone solution of manganese chloride containing manganese chloride at a concentration of 20 wt % was prepared by dissolving manganese chloride tetrahydrate in N-methyl pyrrolidone (N-methyl-2-pyrrolidone) which is an organic solvent (amino-based solvent). The same treatments as in the 10th example were performed, except that 15 ml of this 20 wt % N-methyl pyrrolidone solution of manganese chloride was used as the supporting liquid. Then, the alumina beads floated at a height of 17 mm from the pole face of the superconducting bulk magnet in the vertical direction and the silica glass beads floated at a height of 24 mm therefrom. In this manner, the N-methyl pyrrolidone solution of manganese chloride was used as the supporting liquid and the gradient magnetic field was applied thereto, so that the mixture of silica glass particles and alumina particles could be arranged at different heights corresponding to the types of particles and separated by particle type.

12th Example

Separation of Silica Glass Particles and Alumina Particles

A 20 wt % N,N-dimethylacetamide solution of manganese chloride containing manganese chloride at a concentration of 20 wt % was prepared by dissolving manganese chloride tetrahydrate in N,N-dimethylacetamide which is an organic solvent (amino-based solvent). The same treatments as in the 10th example were performed, except that 15 ml of this 20 wt % N,N-dimethylacetamide solution of manganese chloride was used as the supporting liquid. Then, the alumina beads floated at a height of 16 mm from the pole face of the superconducting bulk magnet in the vertical direction and the silica glass beads floated at a height of 23 mm therefrom. In this manner, the N,N-dimethylacetamide solution of manganese chloride was used as the supporting liquid and the gradient magnetic field was applied thereto, so that the mixture of silica glass particles and alumina particles could be arranged at different heights corresponding to the types of particles and separated by particle type.

13th Example

Separation of Silica Glass Particles and Alumina Particles

A 20 wt % acetone solution of cobalt nitrate containing cobalt nitrate which is a paramagnetic inorganic salt at a concentration of 20 wt % was prepared by dissolving cobalt nitrate hexahydrate in acetone which is an organic solvent (ketone-based solvent). The same treatments as in the 10th example were performed, except that 10 ml of this 20 wt % acetone solution of cobalt nitrate was used as the supporting liquid. Then, the alumina beads floated at a height of 10 mm from the pole face of the superconducting bulk magnet in the vertical direction and the silica glass beads floated at a height of 14 mm therefrom. In this manner, the acetone solution of cobalt nitrate was used as the supporting liquid and the gradient magnetic field was applied thereto, so that the mixture of silica glass particles and alumina particles could be arranged at different heights corresponding to the types of particles and separated by particle type.

14th Example

Separation of Silica Glass Particles and Alumina Particles

Figure 5A:
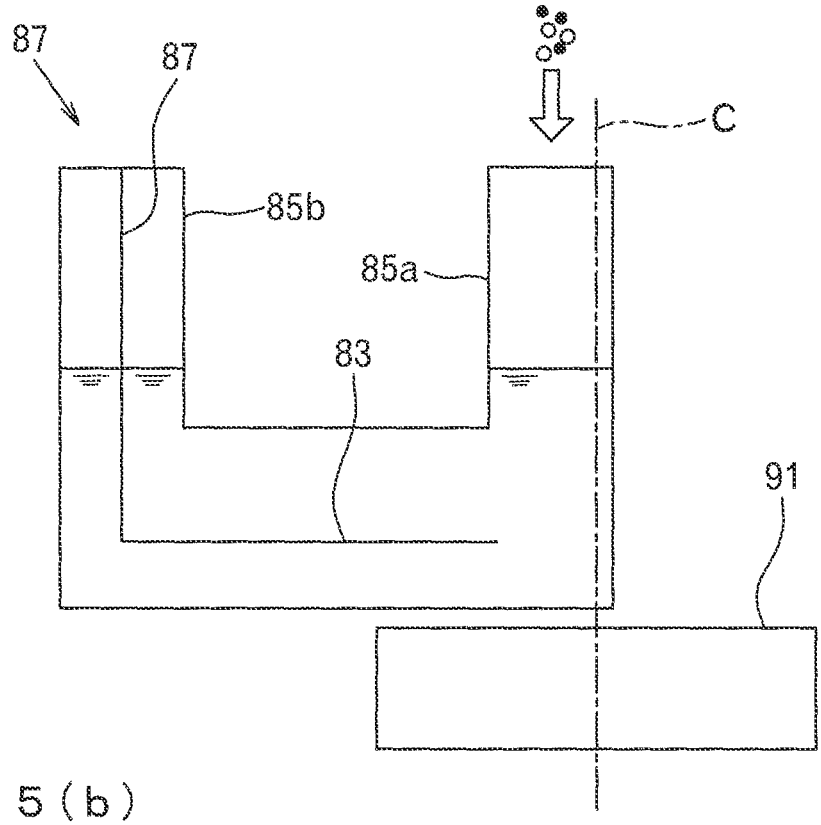
FIGS. 5(*a*) and 5(*b*) are explanatory views schematically showing a separation process of a 14th example to a 26th example of the present invention.
Figure 5B:
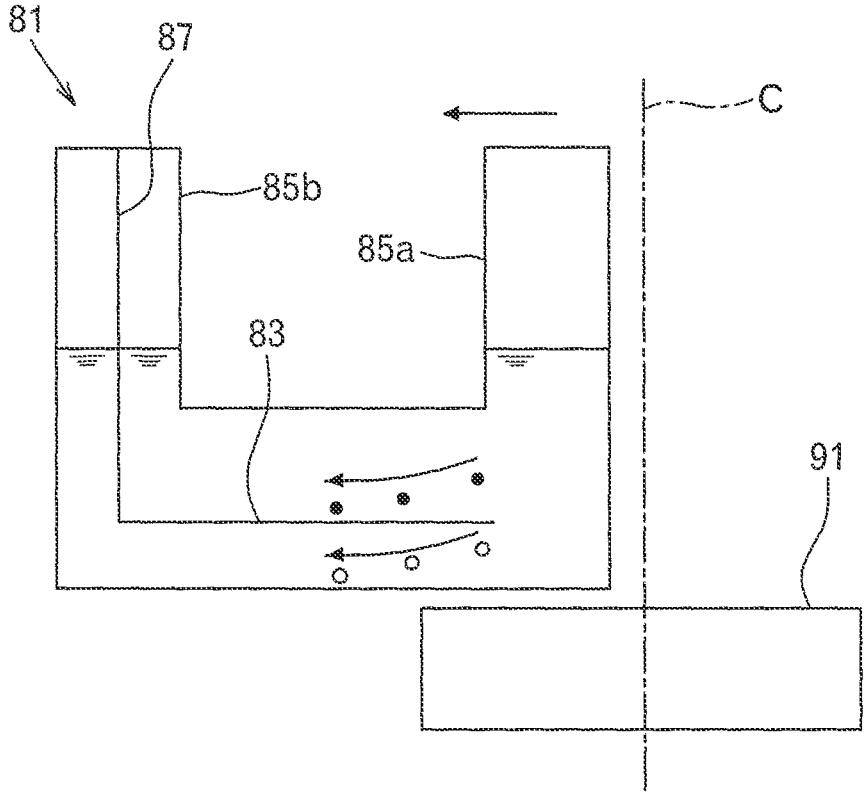

FIGS. 5(*a*) and 5(*b*) are explanatory views schematically illustrating a separation process of a 14th example performed relating to the third embodiment described above. An approximately U-shaped separation tank (81) was manufactured from transparent carbonate. The separation tank (81) had a length of 70 mm, a height of 60 mm, and a width of 2 mm, and a horizontal shelf board (83) was provided at a height of 10 mm from the bottom face. Extending portions (85*a*) and (85*b*) at both ends of the separation tank (81) had open upper ends, and one of the extending portions, that is, the extending portion (85*b*), was provided with a vertical partition plate (87) that was linked to the shelf board (83). A 15 wt % methanol solution of manganese chloride containing manganese chloride at a concentration of 15 wt % was prepared by dissolving manganese chloride tetrahydrate in methanol, and was placed into the separation tank (81) as the supporting liquid.

A mixture of particles of silica glass which is an inorganic oxide and particles of alumina which is an inorganic oxide was prepared, and was placed via the opening of the extending portion (85*a*) into the separation tank (81) disposed over the pole face of a superconducting bulk magnet (91) as shown in FIG. 5(*a*). An acrylic board having a thickness of 3 mm was inserted between the separation tank (81) and the pole face of the superconducting bulk magnet (91) (not shown). The same alumina beads as used in the 10th example were used as alumina particles. Red silica glass particles obtained by crushing red glass beads was included in the silica glass particles in addition to the same transparent silica glass beads as used in the 10th example. The maximum size of the red silica glass particles was approximately 1 mm.

The superconducting bulk magnet (91) was the same magnet as used in the 10th example, and the separation tank (81) was disposed over the pole face of the bulk magnet (91) such that the longitudinal direction of the separation tank (81) was in the radial direction of the bulk magnet (91). Moreover, the separation tank (81) was positioned with respect to the superconducting bulk magnet (91) such that the central axis C of the superconducting bulk magnet (91) passed through the separation tank (81) at a position slightly apart (by approximately several millimeters) from the inner wall of the extending portion (85*a*) of the separation tank (81).

The silica glass particles and the alumina particles placed into the supporting liquid in the separation tank (81) floated in the vicinity of the inner wall of the extending portion (85*a*). In that state, as shown in FIG. 5(*b*), the separation tank (81) was slightly moved horizontally outward in the radial direction of the superconducting bulk magnet (91). The central axis C of the superconducting bulk magnet (91) shifted outside the separation tank (81), and was at a position apart from the outer face of the separation tank (81) by approximately several millimeters.

Figure 6A:
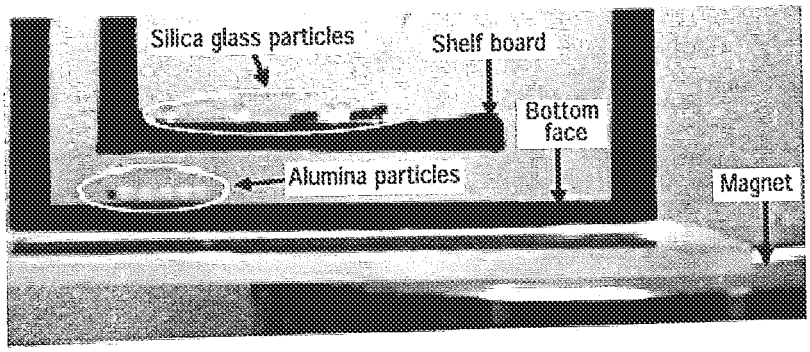
FIGS. 6(*a*) to 6(*c*) are photographs respectively showing a state in which a mixture has been separated by type in a 14th example to a 16th example of the present invention.
Figure 6B:
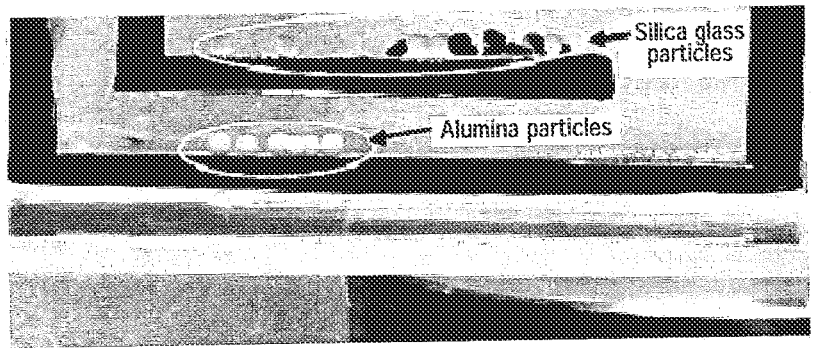
Figure 6C:
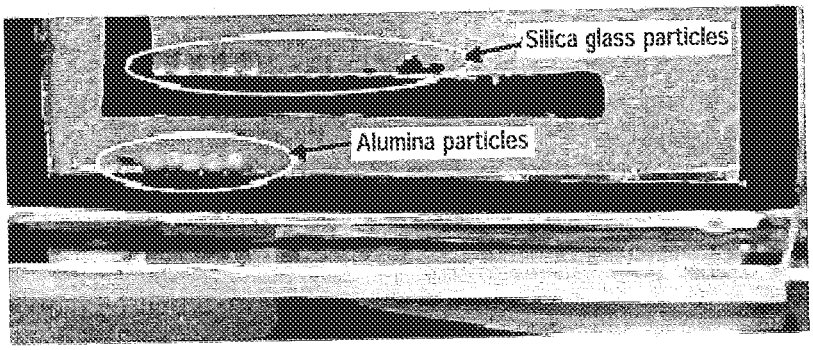

When the separation tank (81) was moved, as schematically shown in FIG. 5(*b*), the silica glass particles and the alumina particles in the supporting liquid sank while traveling toward the extending portion (85*b*) after rising once. Then, as shown in the photograph in FIG. 6(*a*), the silica glass particles were gathered on the shelf board (83), and the alumina particles were gathered on the bottom face of the separation tank (81) (where, as shown in the photograph in FIG. 6(*a*), the separation tank (81) was partly colored with a marker so as to recognize the shape thereof, and the same was done in the photographs according to 15th to 26th examples). In this manner, the methanol solution of manganese chloride was used as the supporting liquid and the magnetic field in which the magnetic field gradient had a vertical component and a horizontal component was applied thereto, so that the mixture of silica glass particles and alumina particles could be made to travel horizontally (while being made to sink) in the supporting liquid and separated by type.

15th to 26th Examples

Separation of Silica Glass Particles and Alumina Particles

In a 15th example, the same treatments as in the 14th example were performed, except that a 15 wt % methanol solution of dysprosium nitrate containing dysprosium nitrate which is a paramagnetic inorganic salt at a concentration of 15 wt % was prepared by dissolving dysprosium nitrate hexahydrate in methanol, and was used as the supporting liquid. Therefore, as shown in the photograph in FIG. 6(*b*), silica glass particles were gathered on the shelf board (83) and alumina particles were gathered on the bottom face of the separation tank (81).

In a 16th example, the same treatments as in the 14th example were performed, except that a 15 wt % methanol solution of terbium nitrate containing terbium nitrate which is a paramagnetic inorganic salt at a concentration of 15 wt % was prepared by dissolving terbium nitrate hexahydrate in methanol, and was used as the supporting liquid. Therefore, as shown in the photograph in FIG. 6(*c*), silica glass particles were gathered on the shelf board (83) and alumina particles were gathered on the bottom face of the separation tank (81).

Figure 7A:
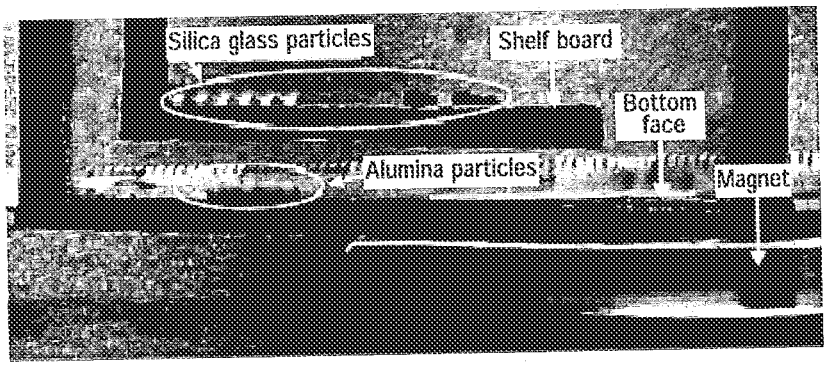
FIGS. 7(*a*) to 7(*c*) are photographs respectively showing a state in which a mixture has been separated by type in a 17th example to a 19th example of the present invention.
Figure 7B:
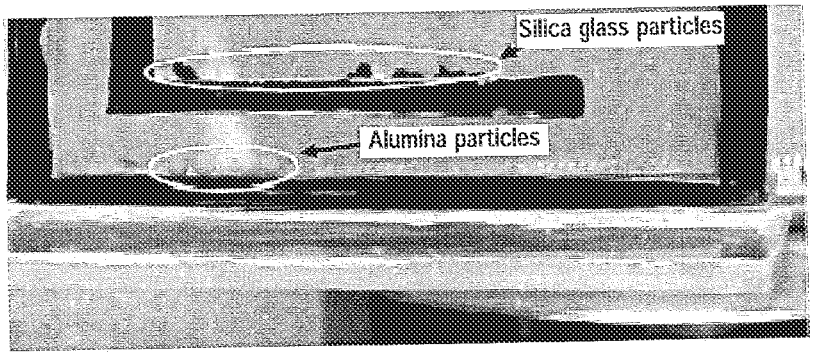
Figure 7C:
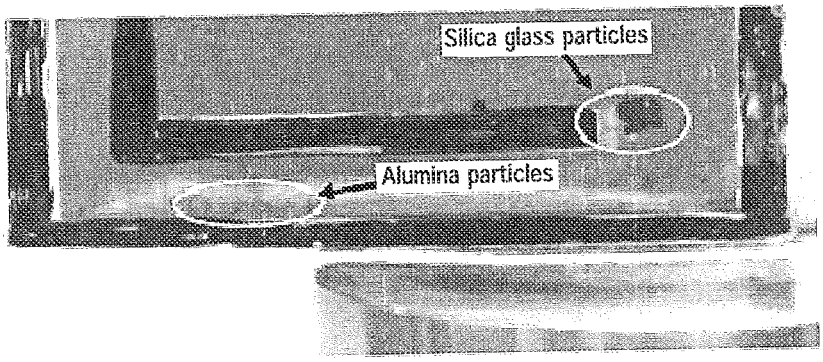

In a 17th example, the same treatments as in the 14th example were performed (where an acrylic board was not used), except that a 15 wt % methanol solution of gadolinium nitrate containing gadolinium nitrate which is a paramagnetic inorganic salt at a concentration of 15 wt % was prepared by dissolving gadolinium nitrate hexahydrate in methanol, and was used as the supporting liquid. Therefore, as shown in the photograph in FIG. 7(*a*), silica glass particles were gathered on the shelf board (83) and alumina particles were gathered on the bottom face of the separation tank (81).

In an 18th example, the same treatments as in the 14th example were performed, except that a 15 wt % methanol solution of holmium nitrate containing holmium nitrate which is a paramagnetic inorganic salt at a concentration of 15 wt % was prepared by dissolving holmium nitrate pentahydrate in methanol, and was used as the supporting liquid. Therefore, as shown in the photograph in FIG. 7(*b*), silica glass particles were gathered on the shelf board (83) and alumina particles were gathered on the bottom face of the separation tank (81).

In a 19th example, the same treatments as in the 14th example were performed (where an acrylic board was not used), except that a 15 wt % methanol solution of cobalt nitrate containing cobalt nitrate which is a paramagnetic inorganic salt at a concentration of 15 wt % was prepared by dissolving cobalt nitrate hexahydrate in methanol, and was used as the supporting liquid. Therefore, as shown in the photograph in FIG. 7(*c*), silica glass particles were gathered at the end portion of the shelf board (83) in a floating state (where the shelf board (83) had a thickness of 2 mm) and alumina particles were gathered on the bottom face of the separation tank (81).

Figure 8A:
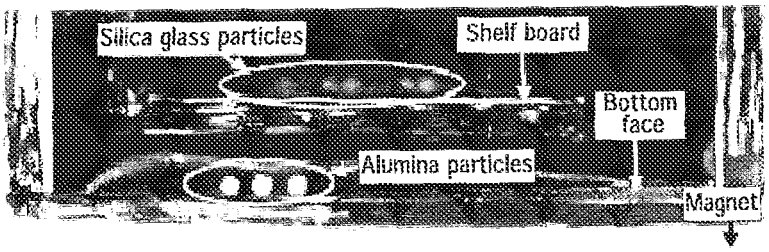
FIGS. 8(*a*) and 8(*b*) are photographs respectively showing a state in which a mixture has been separated by type in a 20th example and a 21st example of the present invention.
Figure 8B:
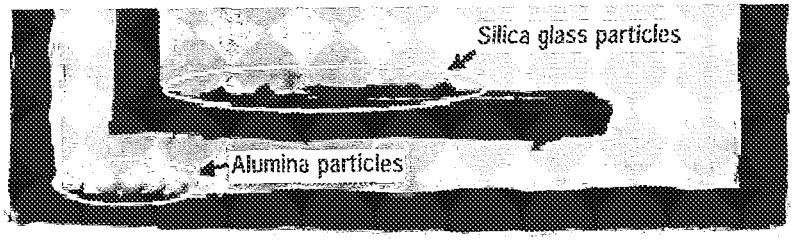

In a 20th example, the same treatments as in the 14th example were performed (where an acrylic board was not used), except that a 15 wt % methanol solution of cobalt chloride containing cobalt chloride which is a paramagnetic inorganic salt at a concentration of 15 wt % was prepared by dissolving cobalt chloride hexahydrate in methanol, and was used as the supporting liquid. Therefore, as shown in the photograph in FIG. 8(*a*), silica glass particles were gathered on the shelf board (83) and alumina particles were gathered on the bottom face of the separation tank (81).

In a 21st example, the same treatments as in the 14th example were performed, except that a 15 wt % methanol solution of iron chloride containing iron chloride which is a paramagnetic inorganic salt at a concentration of 15 wt % was prepared by dissolving iron chloride tetrahydrate in methanol, and was used as the supporting liquid. Therefore, as shown in the photograph in FIG. 8(*b*), silica glass particles were gathered on the shelf board (83) and alumina particles were gathered on the bottom face of the separation tank (81).

Figure 9A:
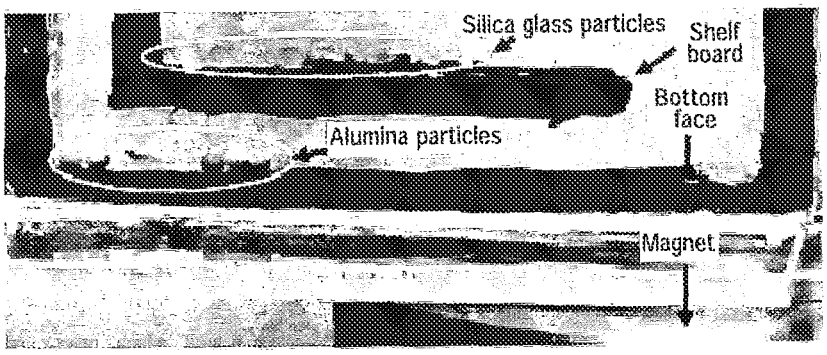
FIGS. 9(*a*) to 9(*c*) are photographs respectively showing a state in which a mixture has been separated by type in a 22nd example to a 24th example of the present invention.
Figure 9B:
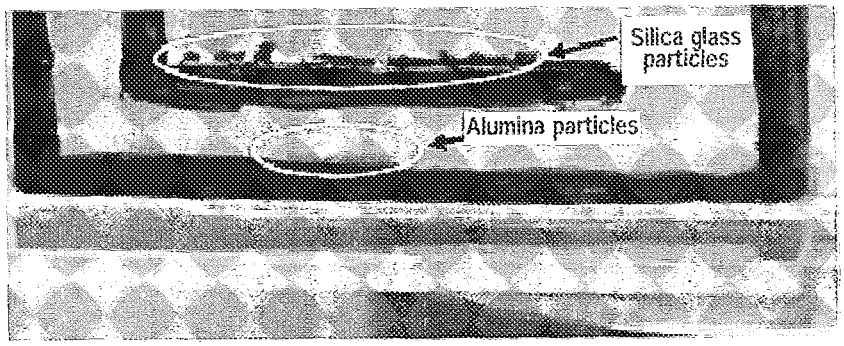
Figure 9C:
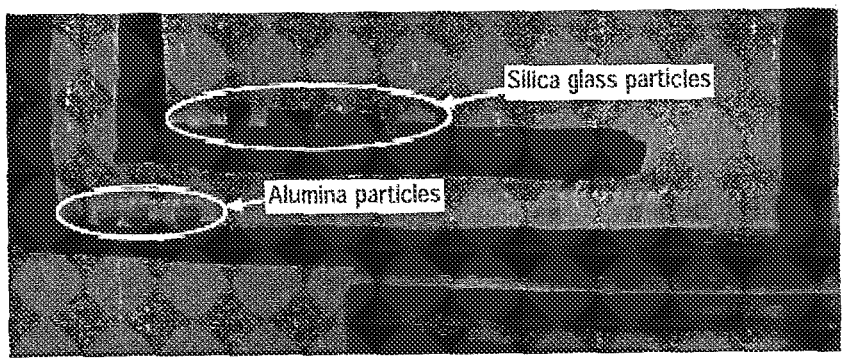

In a 22nd example, the same treatments as in the 14th example were performed, except that a 15 wt % ethanol solution of manganese chloride containing manganese chloride at a concentration of 15 wt % was prepared by dissolving manganese chloride tetrahydrate in ethanol which is an organic solvent (alcohol-based solvent), and was used as the supporting liquid. Therefore, as shown in the photograph in FIG. 9(*a*), silica glass particles were gathered on the shelf board (83) and alumina particles were gathered on the bottom face of the separation tank (81).

In a 23rd example, the same treatments as in the 14th example were performed, except that a 15 wt % ethanol solution of dysprosium nitrate containing dysprosium nitrate at a concentration of 15 wt % was prepared by dissolving dysprosium nitrate hexahydrate in ethanol, and was used as the supporting liquid. Therefore, as shown in the photograph in FIG. 9(*b*), silica glass particles were gathered on the shelf board (83) and alumina particles were gathered on the bottom face of the separation tank (81).

In a 24th example, the same treatments as in the 14th example were performed (where an acrylic board was not used), except that a 15 wt % ethanol solution of gadolinium nitrate containing gadolinium nitrate at a concentration of 15 wt % was prepared by dissolving gadolinium nitrate hexahydrate in ethanol, and was used as the supporting liquid. Therefore, as shown in the photograph in FIG. 9(*c*), silica glass particles were gathered on the shelf board (83) and alumina particles were gathered on the bottom face of the separation tank (81).

Figure 10A:
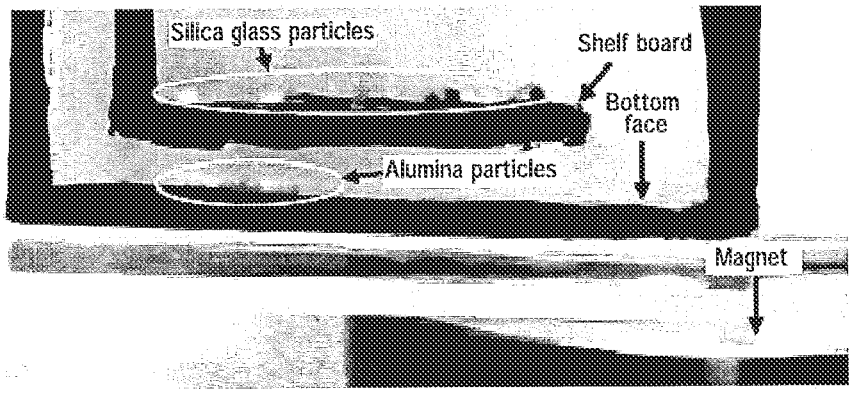
FIGS. 10(*a*) and 10(*b*) are photographs respectively showing a state in which a mixture has been separated by type in a 25th example and a 26th example of the present invention.
Figure 10B:
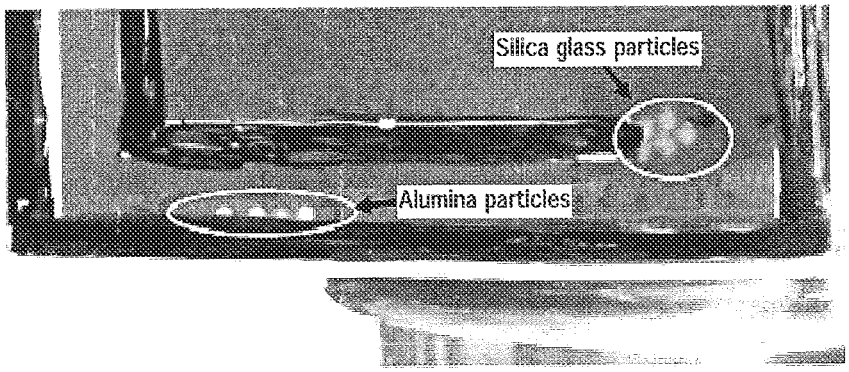

In a 25th example, the same treatments as in the 14th example were performed, except that a 15 wt % ethanol solution of holmium nitrate containing holmium nitrate at a concentration of 15 wt % was prepared by dissolving holmium nitrate pentahydrate in ethanol, and was used as the supporting liquid. Therefore, as shown in the photograph in FIG. 10(*a*), silica glass particles were gathered on the shelf board (83) and alumina particles were gathered on the bottom face of the separation tank (81).

In a 26th example, the same treatments as in the 14th example were performed (where an acrylic board was not used), except that a 15 wt % ethanol solution of cobalt nitrate containing cobalt nitrate at a concentration of 15 wt % was prepared by dissolving cobalt nitrate hexahydrate in ethanol, and was used as the supporting liquid. Therefore, as shown in the photograph in FIG. 10(*b*), silica glass particles were gathered at the end portion of the shelf board (83) in a floating state and alumina particles were gathered on the bottom face of the separation tank (81).

As described above, in the 15th to 26th examples, the methanol solution of dysprosium nitrate, the methanol solution of terbium nitrate, the methanol solution of gadolinium nitrate, the methanol solution of holmium nitrate, the methanol solution of cobalt nitrate, the methanol solution of cobalt chloride, the methanol solution of iron chloride, the ethanol solution of manganese chloride, the ethanol solution of dysprosium nitrate, the ethanol solution of gadolinium nitrate, the ethanol solution of holmium nitrate, and the ethanol solution of cobalt nitrate were used as the supporting liquid and the magnetic field in which the magnetic field gradient had a vertical component and a horizontal component was applied thereto, so that the mixture of silica glass particles and alumina particles could be made to travel horizontally in the supporting liquid and separated by type.

In the 1st to 26th examples described above, it is also possible to appreciate that one type of particles are separated from a mixture containing two types of particles.

Hereinafter, experiments performed relating to the present invention will be described in detail.

1st Experiment

Ten milliliters of the 20 wt % dimethyl sulfoxide solution of manganese chloride used in the 10th example and 0.1 g of potassium chloride particles (powder) were placed into the glass container used in the 1st example and stirred. The glass container was positioned on the neodymium magnet used in the 1st example in the same manner as in the 1st example. Then, it was confirmed that potassium chloride particles floated annularly along the inner wall of the glass container at a height of 3 mm from the pole face in the vertical direction. It can be appreciated from this result that, in the present invention, a dimethyl sulfoxide solution of a paramagnetic inorganic salt such as manganese chloride can be used as the supporting liquid in order to separate a mixture containing inorganic salt particles such as potassium chloride particles.

2nd Experiment

Ten milliliters of the 20 wt % N-methyl pyrrolidone solution of manganese chloride used in the 11th example and 0.1 g of potassium chloride particles (powder) were placed into the glass container used in the 1st example and stirred. The glass container was positioned on the neodymium magnet used in the 1st example in the same manner as in the 1st example. Then, it was confirmed that potassium chloride particles floated annularly along the inner wall of the glass container at a height of 3 mm from the pole face in the vertical direction. It can be appreciated from this result that, in the present invention, an N-methyl pyrrolidone solution of a paramagnetic inorganic salt such as manganese chloride can be used as the supporting liquid in order to separate a mixture containing inorganic salt particles such as potassium chloride particles.

3rd Experiment

A 3 wt % hexane solution of 2,2,6,6-tetramethylpiperidine-1-oxyl free radical (TEMPO) was prepared by dissolving TEMPO which is a paramagnetic organic free radical in n-hexane which is an organic solvent (hydrocarbon solvent) at a concentration of 3 wt %. The chemical formula for TEMPO is shown in the following Formula 1.

[Formula 1]

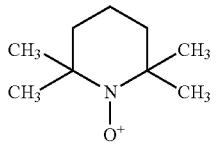

After 10 ml of the 3 wt % hexane solution of TEMPO prepared and 0.1 g of particles of polypropylene resin which is a macromolecular compound (polymer) were placed into the glass container used in the 1st example and stirred, the glass container was positioned on the superconducting bulk magnet used in the 10th example in the same manner as in the 10th example. Polypropylene resin particles had the shape of a rectangle 5 mm square with a thickness of 1 mm. When the glass container was put on the superconducting bulk magnet, it was confirmed that polypropylene resin particles floated at a height of 5 mm from the pole face of the superconducting bulk magnet in the vertical direction. It can be appreciated from this result that, in the present invention, a hexane solution of a paramagnetic organic free radical such as TEMPO can be used as the supporting liquid. Furthermore, it can be appreciated that the present invention can be applied for separating a mixture containing particles formed of a macromolecular compound such as polypropylene resin.

4th Experiment

A 3 wt % toluene solution of TEMPO was prepared by dissolving TEMPO in toluene which is an organic solvent (hydrocarbon solvent) at a concentration of 3 wt %. After 10 ml of the 3 wt % toluene solution of TEMPO prepared and 0.1 g of the same polypropylene resin particles as in the 3rd experiment were placed into the glass container used in the 1st example and stirred, the glass container was positioned on the superconducting bulk magnet used in the 10th example in the same manner as in the 10th example. Then, it was confirmed that polypropylene resin particles floated at a height of 18 mm from the pole face of the superconducting bulk magnet in the vertical direction. It can be appreciated from this result that, in the present invention, a toluene solution of a paramagnetic organic free radical such as TEMPO can be used as the supporting liquid.

5th Experiment

A 3 wt % hexane solution of cobalt was prepared by dissolving cobalt octoate ($C_{16}H_{30}O_4Co$) which is a paramagnetic organic compound complex in n-hexane at a concentration of 3 wt %. Ten milliliters of the 3 wt % hexane solution of cobalt prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles floated at a height of 9 mm from the pole face of the superconducting bulk magnet in the vertical direction. It can be appreciated from this result that, in the present invention, a hexane solution of a paramagnetic organic compound complex such as cobalt octoate can be used as the supporting liquid.

6th Experiment

Figure 11:
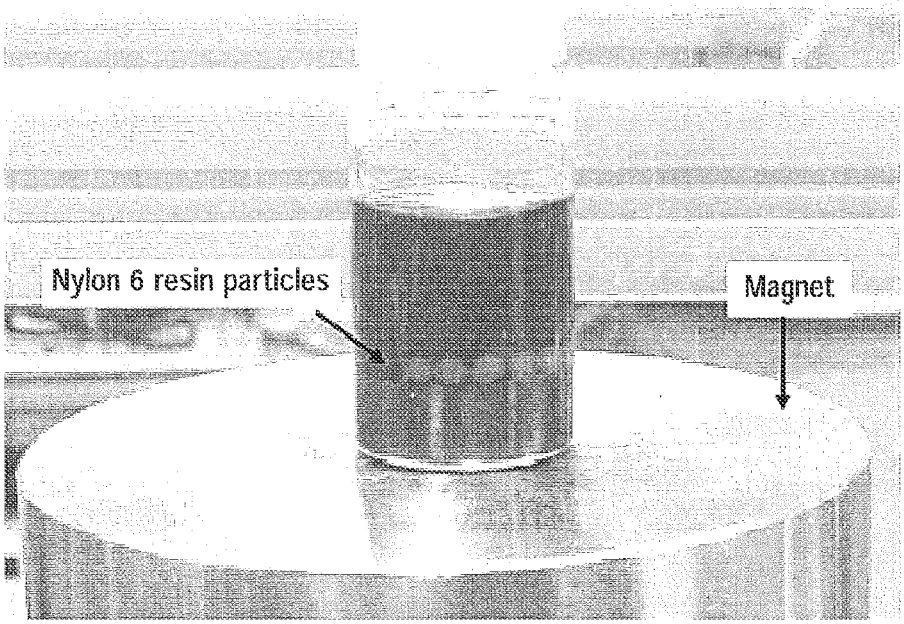
FIG. 11 is a photograph showing a state in which nylon 6 resin particles float in the supporting liquid in a 6th experiment according to the present invention.

A 3 wt % toluene solution of cobalt octoate was prepared by dissolving cobalt octoate in toluene at a concentration of 3 wt %. Ten milliliters of the 3 wt % toluene solution of cobalt octoate prepared and 0.1 g of spherical nylon 6 resin particles were placed into the glass container used in the 1st example and stirred. The glass container was positioned on the superconducting bulk magnet used in the 10th example in the same manner as in the 10th example. Then, as shown in the photograph in FIG. 11, it was confirmed that nylon 6 resin particles floated at a height of 8 mm from the pole face of the superconducting bulk magnet in the vertical direction. It is appreciated from this result that, in the present invention, a toluene solution of a paramagnetic organic compound complex such as cobalt octoate can be used as the supporting liquid. Furthermore, it can be appreciated that the present invention can be applied for separating a mixture containing particles formed of a nylon 6 resin.

7th Experiment

A saturated toluene solution of iron (II) phthalocyanine was prepared by dissolving iron (II) phthalocyanine which is a paramagnetic organic compound complex in toluene at a saturated concentration. The chemical formula for iron (II) phthalocyanine is shown in the following Formula 2.

[Formula 2]

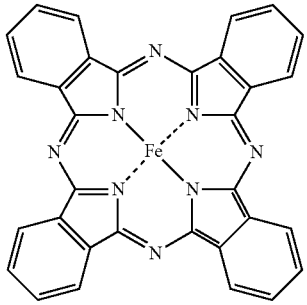

Figure 12:
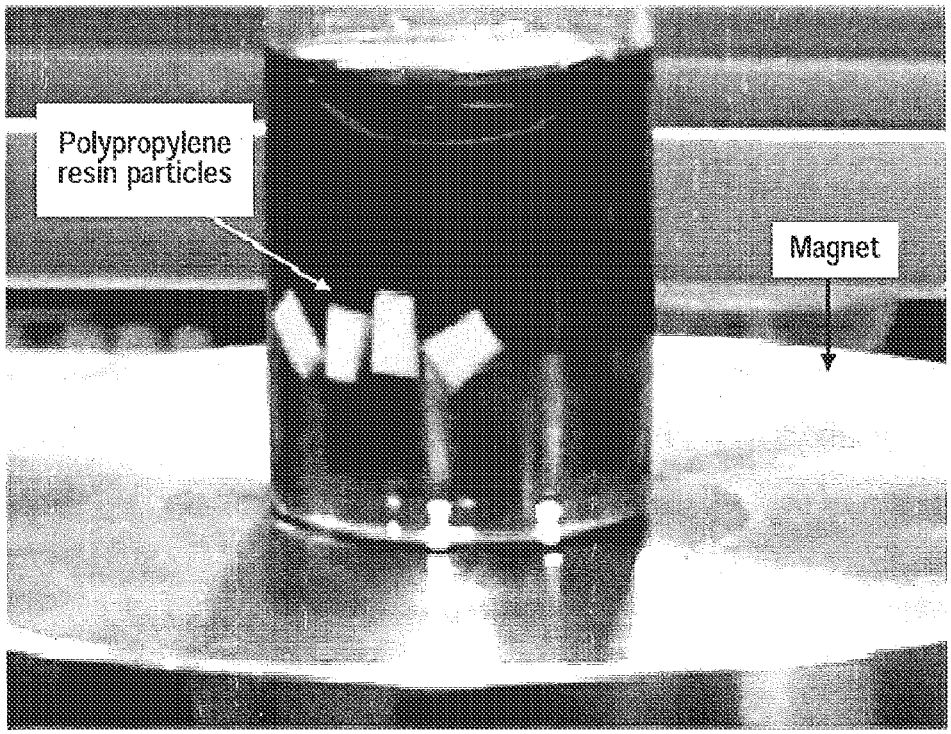
FIG. 12 is a photograph showing a state in which polypropylene resin particles float in the supporting liquid in a 7th experiment according to the present invention.

Ten milliliters of the saturated toluene solution of iron (II) phthalocyanine prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, as shown in the photograph in FIG. 12, it was confirmed that polypropylene resin particles floated at a height of 10 mm from the pole face of the superconducting bulk magnet in the vertical direction. It can be appreciated from this result that, in the present invention, a toluene solution of iron (II) phthalocyanine can be used as the supporting liquid.

8th Experiment

A saturated hexane solution of iron (III) acetylacetone was prepared by dissolving iron (III) acetylacetone which is a paramagnetic organic compound complex in hexane at a saturated concentration. The chemical formula for iron (III) acetylacetone is shown in the following Formula 3.

[Formula 3]

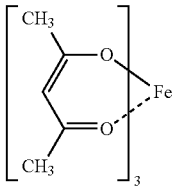

Ten milliliters of the saturated hexane solution of iron (III) acetylacetone prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles floated at a height of 2 mm from the pole face of the superconducting bulk magnet in the vertical direction. It can be appreciated from this result that, in the present invention, a hexane solution of iron (III) acetylacetone can be used as the supporting liquid.

9th Experiment

A saturated toluene solution of iron (III) acetylacetone was prepared by dissolving iron (III) acetylacetone in toluene at a saturated concentration. Ten milliliters of the saturated toluene solution of iron (III) acetylacetone prepared and 0.1 g of spherical nylon 6 resin particles were placed into the glass container used in the 1st example and stirred. The glass container was positioned on the superconducting bulk magnet used in the 10th example in the same manner as in the 10th example. Then, it was confirmed that nylon 6 resin particles floated at a height of 15 mm from the pole face of the superconducting bulk magnet in the vertical direction. It can be appreciated from this result that, in the present invention, a toluene solution of iron (III) acetylacetone can be used as the supporting liquid.

10th Experiment

A saturated toluene solution of tris(dibenzoylmethanato) iron was prepared by dissolving tris(dibenzoylmethanato) iron which is a paramagnetic organic compound complex in toluene at a saturated concentration. The chemical formula for tris(dibenzoylmethanato) iron is shown in the following Formula 4.

[Formula 4]

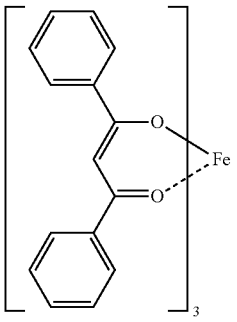

Ten milliliters of the saturated toluene solution of tris (dibenzoylmethanato) iron prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles floated at a height of 15 mm from the pole face of the superconducting bulk magnet in the vertical direction. It can be appreciated from this result that, in the present invention, a toluene solution of tris(dibenzoylmethanato) iron can be used as the supporting liquid.

11th Experiment

A saturated toluene solution of N,N'-bis(salicylidene)ethylenediamine iron (II) was prepared by dissolving N,N'-bis (salicylidene)ethylenediamine iron (II) in toluene at a saturated concentration. The chemical formula for N,N'-bis (salicylidene)ethylenediamine iron (II) is shown in the following Formula 5.

[Formula 5]

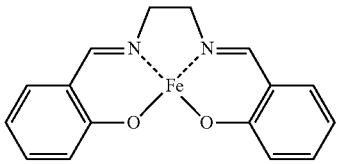

Ten milliliters of the saturated toluene solution of N,N'-bis (salicylidene)ethylenediamine iron (II) prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles floated at a height of 10 mm from the pole face of the superconducting bulk magnet in the vertical direction. It can be appreciated from this result that, in the present invention, a toluene solution of N,N'-bis (salicylidene)ethylenediamine iron (II) can be used as the supporting liquid.

12th Experiment

A saturated acetonitrile solution of cobalt nitrate was prepared by dissolving cobalt nitrate which is a paramagnetic inorganic salt in acetonitrile which is an organic solvent (nitrile-based solvent) at a saturated concentration. Ten milliliters of the saturated acetonitrile solution of cobalt nitrate prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles levitated at a height of 8 mm from the pole face of the superconducting bulk magnet in the vertical direction. It can be appreciated from this result that, in the present invention, an acetonitrile solution of a paramagnetic inorganic salt such as cobalt nitrate can be used as the supporting liquid.

13th Experiment

A 5 wt % ethyl acetate solution of iron (III) acetylacetone was prepared by dissolving iron (III) acetylacetone which is a paramagnetic organic compound complex in ethyl acetate which is an organic solvent (ester-based solvent) at a concentration of 5 wt %. Ten milliliters of the 5 wt % ethyl acetate solution of iron (III) acetylacetone prepared and 0.1 g of potassium chloride particles (powder) were placed into the glass container used in the 1st example and stirred. The glass container was positioned on the superconducting bulk magnet used in the 10th example in the same manner as in the 10th example. Then, it was confirmed that potassium chloride particles floated annularly along the inner wall of the glass container at a height of 4 mm from the pole face of the superconducting bulk magnet in the vertical direction. It can be appreciated from this result that, in the present invention, an ethyl acetate solution of a paramagnetic organic compound complex such as iron (III) acetylacetone can be used as the supporting liquid.

14th Experiment

A saturated diethyl ether solution of iron (III) acetylacetone was prepared by dissolving iron (III) acetylacetone in diethyl ether which is an organic solvent (ether-based solvent) at a saturated concentration. Ten milliliters of the saturated diethyl ether solution of iron (III) acetylacetone prepared and 0.1 g of the same polypropylene resin particles as in the 3rd experiment were placed into the glass container used in the 1st example and stirred. The glass container was positioned on the superconducting bulk magnet used in the 10th example in the same manner as in the 10th example. Then, it was confirmed that polypropylene resin particles floated at a height of 6 mm from the pole face in the vertical direction. It can be appreciated from this result that, in the present invention, a diethyl ether solution of a paramagnetic organic compound complex such as iron (III) acetylacetone can be used as the supporting liquid.

15th Experiment

Figure 13:
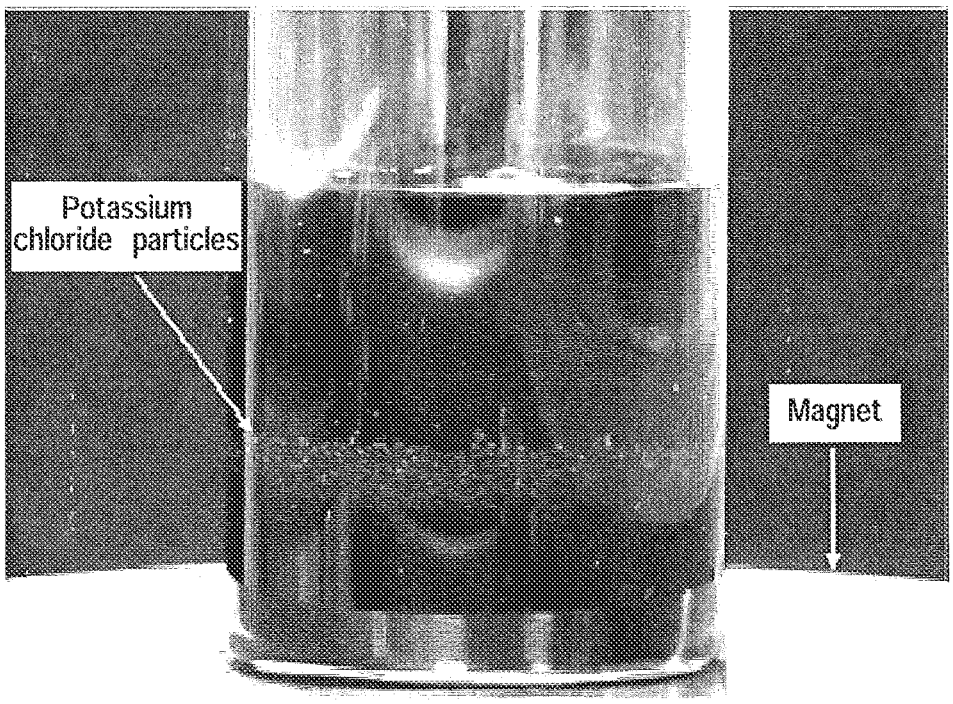
FIG. 13 is a photograph showing a state in which potassium chloride particles float in the supporting liquid in a 15th experiment according to the present invention.

A 5 wt % dichloromethane solution of iron (III) acetylacetone was prepared by dissolving iron (III) acetylacetone in dichloromethane which is an organic solvent (halomethane-based solvent) at a concentration of 5 wt %. Ten milliliters of the 5 wt % dichloromethane solution of iron (III) acetylacetone prepared and 0.1 g of potassium chloride particles (powder) were placed into the glass container used in the 1st example and stirred. The glass container was positioned on the superconducting bulk magnet used in the 10th example in the same manner as in the 10th example. Then, as shown in the photograph in FIG. 13, it was confirmed that potassium chloride particles floated annularly along the inner wall of the glass container at a height of 12 mm from the pole face of the superconducting bulk magnet in the vertical direction. It can be appreciated from this result that, in the present invention, a dichloromethane solution of a paramagnetic organic compound complex such as iron (III) acetylacetone can be used as the supporting liquid.

16th Experiment

A 5 wt % tetrahydrofuran solution of iron (III) acetylacetone was prepared by dissolving iron (III) acetylacetone in tetrahydrofuran which is an organic solvent (ether-based solvent) at a concentration of 5 wt %. Ten milliliters of the 5 wt % tetrahydrofuran solution of iron (III) acetylacetone prepared and 0.1 g of potassium chloride particles (powder) were placed into the glass container used in the 1st example and stirred. The glass container was positioned on the superconducting bulk magnet used in the 10th example in the same manner as in the 10th example. Then, it was confirmed that potassium chloride particles floated annularly along the inner wall of the glass container at a height of 4 mm from the pole face of the superconducting bulk magnet in the vertical direction. It can be appreciated from this result that, in the present invention, a tetrahydrofuran solution of a paramagnetic organic compound complex such as iron (III) acetylacetone can be used as the supporting liquid.

17th Experiment

A 10 wt % n-propanol solution of cobalt nitrate containing cobalt nitrate at a concentration of 10 wt % was prepared by dissolving cobalt nitrate hexahydrate in n-propanol which is an organic solvent (alcohol-based solvent). Ten milliliters of the 10 wt % n-propanol solution of cobalt nitrate prepared and 0.1 g of the same polypropylene resin particles as in the 3rd experiment were placed into the glass container used in the 1st example and stirred. The glass container was positioned on the neodymium magnet used in the 1st example in the same manner as in the 1st example. Then, it was confirmed that polypropylene resin particles floated at a height of 8 mm from the pole face of the neodymium magnet in the vertical direction. It can be appreciated from this result that, in the present invention, an n-propanol solution of a paramagnetic inorganic salt such as cobalt nitrate can be used as the supporting liquid.

18th Experiment

A 10 wt % iso-propanol solution of cobalt nitrate containing cobalt nitrate at a concentration of 10 wt % was prepared by dissolving cobalt nitrate hexahydrate in iso-propanol which is an organic solvent (alcohol-based solvent). Ten milliliters of the 10 wt % iso-propanol solution of cobalt nitrate prepared and 0.1 g of the same polypropylene resin particles as in the 3rd experiment were placed into the glass container used in the 1st example and stirred. The glass container was positioned on the neodymium magnet used in the 1st example in the same manner as in the 1st example. Then, it was confirmed that polypropylene resin particles floated at a height of 5 mm from the pole face of the neodymium magnet in the vertical direction. It can be appreciated from this result that, in the present invention, an iso-propanol solution of a paramagnetic inorganic salt such as cobalt nitrate can be used as the supporting liquid.

Other Experiments

The following Table 1 shows floating heights of various inorganic salts, inorganic oxides and organic acid salts when using the 40 wt % methanol solution of manganese chloride and the neodymium magnet used in the 1st example, floating heights thereof when using the 20 wt % methanol solution of manganese chloride and the superconducting bulk magnet used in the 10th example, and floating heights thereof when using the 40 wt % methanol solution of manganese chloride and the superconducting bulk magnet used in the 10th example (where floating heights are not described in some cases). Table 1 also shows the volume susceptibility (SI unit system) and the specific gravity ($g/cm^3$) of respective types of particles (or materials) (where the volume susceptibility and the specific gravity of some types of particles are not described). Note that the values of the volume susceptibility of inorganic salts and inorganic oxides are found by transforming molar susceptibility which is described in Handbook of Chemistry (5th edition, Fundamentals No. 2, pp. 629-638, published by Maruzen Co., Ltd., edited by The Chemical Society of Japan). The values of the volume susceptibility of organic acid salts are obtained by being measured using a superconducting magnetic flux quantum interference device (SQUID).

TABLE 1

| | Particle | Volume susceptibility SI unit system χ | Specific gravity (g/cm$^3$) | Floating height (mm) 0.4 T-0.5 T neodymium magnet 40 wt % $MnCl_2$ MeOH solution | Floating height (mm) 3 T bulk magnet 20 wt % $MnCl_2$ MeOH solution | Floating height (mm) 3 T bulk magnet 40 wt % $MnCl_2$ MeOH solution |
|---|---|---|---|---|---|---|
| Inorganic salt | $CaCl_2$ | −1.33E−05 | 2.15 | 8 | 25 | 35 |
| | $MgCl_2$ | −1.46E−05 | 2.33 | 8 | 28 | 44 |
| | LiCl | −1.51E−05 | 2.10 | 6 | 25 | 40 |
| | KCl | −1.30E−05 | 1.99 | 6 | 23 | 33 |
| | NaCl | −1.40E−05 | 2.16 | 4.5 | 22 | 31 |
| | KBr | | 2.75 | 4 | 18 | 23 |
| | CsCl | −1.69E−05 | 3.99 | 2 | 14 | 22 |
| | $BaCl_2$ | | 3.86 | 1.5 | 15 | 23 |
| | $NH_4Cl$ | −1.32E−05 | 1.53 | 9 | 28 | 45 |
| | $Na_2CO_3$ | −1.23E−05 | 2.54 | 5 | 22 | 31 |
| | $CaCO_3$ | −1.21E−05 | 2.71 | 3 | 18 | 28 |
| | $Na_3PO_4 \cdot 12H_2O$ | | 1.62 | 7 | 25 | 41 |
| | $Na_2HPO_4 \cdot 12H_2O$ | | 1.52 | 9 | 28 | 45 |
| | $NaH_2PO_4 \cdot 2H_2O$ | | 1.92 | 6 | 22 | 36 |
| | $KH_2PO_4$ | | 2.34 | 4 | 20 | 30 |
| | $Ca(NO_3)_2 \cdot 4H_2O$ | | 1.86 | 6 | 25 | 37 |
| | $(NH_4)_2SO_4$ | −1.13E−05 | 1.77 | 6 | 25 | 38 |
| | $MgSO_4$ | | 2.65 | 3 | 17 | 26 |
| Inorganic oxide | $SiO_2$ | −1.36E−05 | 2.20 | 5 | 18 | 26 |
| | $ZrO_2$ | | 5.89 | 2 | 9 | 18 |
| | $Al_2O_3$ | −1.81E−05 | 3.97 | 1.5 | 14 | 21 |
| | PdO | | 8.70 | 1 | 7 | 13 |
| Organic acid salt | $CH_3COOK$ | | 1.57 | 8 | 30 | 56 |
| | $CH_3COONa$ | −6.59E−06 | 1.45 | 8 | 29 | 40 |
| | $CH_3(CH_2)_6COONa$ | −7.25E−06 | 0.99 | −4* | 40 | |
| | $CH_3(CH_2)_{16}COONa$ | −7.27E−06 | | −5* | | |
| | $C_7H_{15}NaO_3S$ | | 1.02 | −11* | 35 | |

Inorganic salts of which the floating heights of particles are shown in Table 1 are as follows: calcium chloride ($CaCl_2$), magnesium chloride ($MgCl_2$), lithium chloride (LiCl), potassium chloride (KCl), sodium chloride (NaCl), potassium bromide (KBr), cesium chloride (CsCl), barium chloride ($BaCl_2$), ammonium chloride ($NH_4Cl$), sodium carbonate ($Na_2CO_3$), calcium carbonate ($CaCO_3$), trisodium phosphate dodecahydrate ($Na_3PO_4.12H_2O$), disodium hydrogen phosphate dodecahydrate ($Na_2HPO_4.12H_2O$), sodium dihydrogen phosphate dihydrate ($NaH_2PO_4.2H_2O$), potassium dihydrogen phosphate ($KH_2PO_4$), calcium nitrate tetrahydrate ($Ca(NO_3)_2.4H_2O$), ammonium sulfate ($(NH_4)_2SO_4$), and magnesium sulfate ($MgSO_4$).

Inorganic oxides of which the floating heights of particles are shown in Table 1 are as follows: silicon dioxide ($SiO_2$), zirconium oxide ($ZrO_2$), aluminum oxide (alumina) ($Al_2O_3$), and palladium oxide (PdO).

Organic acid salts of which the floating heights of particles are shown in Table 1 are as follows: potassium acetate ($CH_3COOK$), sodium acetate ($CH_3COONa$), sodium octanoate ($CH_3(CH_2)_6COONa$), sodium stearate ($CH_3(CH_2)_{16}COONa$), and sodium 1-heptanesulfonate ($C_7H_{15}NaO_3S$).

When the 40 wt % methanol solution of manganese chloride and the neodymium magnet were used, a measurement of a floating height was performed by placing 0.1 g of particles with 10 ml of the 40 wt % methanol solution of manganese chloride (prepared as in the 1st example) into the glass container used in the 1st example, and by positioning the glass container on the pole face of the neodymium magnet in the same manner as in the 1st example (except for the cases denoted by an asterisk). When the 20 wt % or the 40 wt % methanol solution of manganese chloride and the superconducting bulk magnet were used, a measurement of a floating height was performed by placing 0.1 g of particles with 20 ml of the 20 wt % methanol solution of manganese chloride (prepared as in the 3rd example) or the 40 wt % methanol solution of manganese chloride (prepared as in the 1st example) into the glass container used in the 1st example, and by positioning the glass container on the pole face of the superconducting bulk magnet in the same manner as in the 10th example.

As results of the measurement, values obtained by measuring a floating height from the pole face are shown in Table 1. Palladium oxide (PdO) particles of which the levitating height was 1 mm were on the bottom face of the glass container when the neodymium magnet was used.

In the cases denoted by an asterisk in results of the measurement shown in Table 1, 23.5 ml of the 40 wt % methanol solution of manganese chloride and 0.1 g of particles were placed into the glass container and stirred. Moreover, a lid was put on the glass container. The glass container was positioned on the pole face of the neodymium magnet in the same manner as in the 1st example, and the glass container and the neodymium magnet were inverted while maintaining the state of the bottom portion of the glass container abutting on the pole face of the neodymium magnet. Then, a floating position of particles from the pole face of the neodymium magnet on which the glass container abutted was measured (where measured values are prefixed with a minus sign because the floating position was below the pole face).

Each of the types of particles shown in Table 1 may be contained in a mixture to be treated by the present invention given that they float in the supporting liquid, and it is obvious that these types of particles can be separated from the mixture using the present invention. Furthermore, it can be appreciated from the results shown in Table 1 that the resolution of particle separation (particle position) is improved when a magnitude of a magnetic field or a magnetic field gradient becomes large, or when a paramagnetic compound (manganese chloride) is at a high concentration in the supporting liquid.

Hereinafter, experiments performed relating to the present invention as a comparative example will be described in detail.

1st Comparative Example

An aqueous solution containing manganese chloride at a concentration of 40 wt % was prepared, and 10 ml of the 40 wt % aqueous solution of manganese chloride prepared and a mixture of 0.1 g of potassium chloride particles and 0.1 g of sodium chloride particles were placed into the glass container used in the 1st example and stirred. However, the mixture dissolved therein and could not be confirmed visually.

2nd Comparative Example

An aqueous solution containing manganese chloride at a concentration of 30 wt % was prepared, and 10 ml of the 30 wt % aqueous solution of manganese chloride prepared and a mixture of 0.1 g of potassium chloride particles and 0.1 g of sodium chloride particles were placed into the glass container used in the 1st example and stirred. However, the mixture dissolved therein and could not be confirmed visually.

As can be appreciated from the results of the first comparative example and the second comparative example, with a conventional method in which an aqueous solution of a paramagnetic inorganic salt such as manganese chloride is used as the supporting liquid, it is difficult to magnetically levitate potassium chloride particles and sodium chloride particles using the magneto-Archimedes effect, and it is difficult to separate a mixture of potassium chloride particles and sodium chloride particles into potassium chloride particles and sodium chloride particles. Also, it is difficult to separate potassium chloride particles or sodium chloride particles from a mixture containing potassium chloride particles and sodium chloride particles by a conventional method. On the other hand, when the present invention is used, a mixture containing potassium chloride particles and sodium chloride particles can be separated (see the 1st example, etc.).

3rd Comparative Example

Ten milliliters of a 40 wt % aqueous solution of manganese chloride and 0.1 g of sodium acetate particles were placed into the glass container used in the 1st example and stirred. However, sodium acetate particles dissolved therein and could not be confirmed visually. On the other hand, as shown in Table 1, sodium acetate particles can be magnetically levitated when a 40 wt % methanol solution of manganese chloride is used as the supporting liquid instead of the 40 wt % aqueous solution of manganese chloride.

4th Comparative Example

Ten milliliters of a 40 wt % aqueous solution of manganese chloride and 0.1 g of sodium stearate particles were placed into the glass container described above and stirred. However, sodium stearate particles agglomerated in the 40 wt % aqueous solution of manganese chloride and formed a large mass. On the other hand, as shown in Table 1, sodium stearate particles floated annularly along the inner wall of the glass container when a 40 wt % methanol solution of manganese chloride was used as the supporting liquid instead of the 40 wt % aqueous solution of manganese chloride, and a gradient magnetic field was applied thereto.

INDUSTRIAL APPLICABILITY

With the present invention, it is possible to separate, by particle type, a mixture of a plurality of types of particles including particles of an inorganic salt, an organic acid salt, an inorganic oxide or a macromolecular compound, or to separate a specific type of particle, especially particles of an inorganic salt, an organic acid salt, an inorganic oxide or a macromolecular compound, from the mixture. The mixture to be treated by the present invention may be industrial waste, and the present invention can, for example, be used to treat incinerated ash produced by incineration of urban waste and collect potassium chloride and sodium chloride contained in the incinerated ash.

When hydrocarbons are subjected to industrial air oxidation, a mixture containing organic acids with various carbon chains is generated. At present, when a specific organic acid is separated from this mixture, esterification, purification by distillation and hydrolysis are carried out. Simplification of the separation process can be expected by applying the present invention to a process for separating a desired organic acid from the mixture generated by subjecting hydrocarbons to air oxidation.

Natural bittern contains potassium chloride, sodium chloride and magnesium chloride. The present invention can be applied to a process for separating and collecting these particles from natural bittern by type.

The description above has been given for illustrating the present invention, and should not be construed as limiting the invention described in the claims or as restricting the claims. Furthermore, it will be appreciated that the constituent elements of the invention are not limited to those in the foregoing examples, and various modifications can be made without departing from the technical scope described in the claims.

LIST OF REFERENCE NUMERALS (1) Separation apparatus
(3) Separation apparatus
(5) Separation apparatus
(11) Separation tank
(13) Separation tank
(15) Separation tank
(17) Hopper
(19) Shelf board
(21) Mixture storage tank
(23) First particle storage tank
(25) Second particle storage tank
(27) Mixture storage tank
(29) Second particle storage tank
(31) First particle storage tank
(61) Electromagnet
(63) Electromagnet
(65) Bulk magnet
(71) First particle suction tube
(73) Second particle suction tube
(75) First particle suction tube
(77) First particle suction tube
(79) Second particle suction tube

The invention claimed is:

1. A mixture separation method for applying a magnetic field having a magnetic field gradient to a mixture containing a plurality of types of particles formed of mutually different materials in a supporting liquid to separate the plurality of types of particles by type or separate a specific type of particles from the mixture, wherein the magnetic field gradient has a vertical component and a horizontal component, the plurality of types of particles travel horizontally in the supporting liquid, and are arranged at mutually different heights depending on a density and a volume susceptibility of the material forming each type of particles, by applying the magnetic field to the mixture in the supporting liquid, the supporting liquid is an organic solvent solution obtained by dissolving one or more types of paramagnetic compounds in an organic solvent, and the plurality of types of particles include particles of an inorganic salt, an organic acid salt, an inorganic oxide or a macromolecular compound.

2. The mixture separation method according to claim 1, wherein the organic solvent is selected from the group consisting of alcohols, ethers, nitriles, ketones, esters, amides, sulfoxides, halomethanes and hydrocarbon solvents.

3. The mixture separation method according to claim 1, wherein the organic solvent is selected from the group consisting of methanol, ethanol, n-propanol, iso-propanol, diethyl ether, tetrahydrofuran, acetonitrile, acetone, ethyl acetate, N-methyl pyrrolidone, N,N-dimethylacetamide, dimethyl sulfoxide, dichloromethane, hexane, and toluene.

4. The mixture separation method according to claim 1, wherein each of the one or more types of paramagnetic compounds is selected from the group consisting of paramagnetic inorganic salts, paramagnetic organic free radicals and paramagnetic organic compound complexes.

5. The mixture separation method according to claim 1, wherein each of the one or more types of paramagnetic compounds is selected from the group consisting of manganese chloride, cobalt chloride, iron chloride, dysprosium nitrate, terbium nitrate, gadolinium nitrate, holmium nitrate, cobalt nitrate, 2,2,6,6-tetramethylpiperidine-1-oxyl free radical, cobalt octoate, iron (II) phthalocyanine, iron (III) acetylacetone, tris(dibenzoylmethanato) iron, and N,N'-bis(salicylidene)ethylenediamine iron (II).

6. The mixture separation method according to claim 1, wherein the inorganic salt is selected from the group consisting of alkali metal halides, alkali metal phosphates, alkali metal carbonates, alkaline earth metal halides, alkaline earth metal carbonates, alkaline earth metal nitrates, alkaline earth metal sulfates, and ammonium salts of strong acids.

7. The mixture separation method according to claim 1, wherein the organic acid salt is an alkali metal salt of an organic carboxylic acid or an organic sulfonic acid.

8. The mixture separation method according to claim 1, wherein the inorganic oxide is an oxide of a semimetal element.

9. The mixture separation method according to claim 1, wherein the macromolecular compound is a polymer.

10. The mixture separation method according to claim 1, wherein the specific type of particles are particles of an inorganic salt, an organic acid salt, an inorganic oxide or a macromolecular compound, and float in the supporting liquid by applying the gradient magnetic field to the mixture in the supporting liquid.

* * * * *